US009010070B2

(12) United States Patent
Darr, III et al.

(10) Patent No.: US 9,010,070 B2
(45) Date of Patent: Apr. 21, 2015

(54) STRUCTURAL FRAMING MEMBER

(75) Inventors: Leslie Rogers Darr, III, Hoschton, GA (US); Jeremy Ryan Smith, Carrollton, VA (US); Michael Francis Cavanaugh, Hampstead, NH (US); Terry Robert Westerman, Loveland, OH (US); James Michael Wielinga, West Chester, OH (US); Gregory S. Ralph, Lewis Center, OH (US); Nagaraj Eshwar, Willbrook, IL (US); Thomas J. Lawson, Dyer, IN (US); David Lee Keebler, West Chester, OH (US)

(73) Assignee: Clarkwestern Dietrich Building Systems LLC, West Chester, OH (US)

( * ) Notice: Subject to any disclaimer, the term of this patent is extended or adjusted under 35 U.S.C. 154(b) by 0 days.

(21) Appl. No.: 13/390,253

(22) PCT Filed: Aug. 16, 2010

(86) PCT No.: PCT/US2010/045609

§ 371 (c)(1),
(2), (4) Date: Feb. 13, 2012

(87) PCT Pub. No.: WO2011/020093

PCT Pub. Date: Feb. 17, 2011

(65) Prior Publication Data

US 2012/0216480 A1 Aug. 30, 2012

Related U.S. Application Data

(60) Provisional application No. 61/234,084, filed on Aug. 14, 2009.

(51) Int. Cl.
*E04C 2/34* (2006.01)
*E04C 3/07* (2006.01)

(52) U.S. Cl.
CPC ..... *E04C 3/07* (2013.01); *E04B 2/7457* (2013.01); *E04B 2/763* (2013.01); *E04B 2/789* (2013.01); *E04C 2003/0473* (2013.01)

(58) Field of Classification Search
USPC ..... 52/481.1, 483.1, 831, 846, 836, 850, 52/851, 650.1, 653.1, 481.2
See application file for complete search history.

(56) References Cited

U.S. PATENT DOCUMENTS 681,355 A 8/1901 Turnbull
1,856,898 A 5/1932 Wood (Continued)

FOREIGN PATENT DOCUMENTS

CA 2499227 9/2006
CA 2568111 5/2008

(Continued)

OTHER PUBLICATIONS

International Search Report and Written Opinion dated Jun. 8, 2011 for Application No. PCT/US2010/045609.

(Continued)

*Primary Examiner* — Beth Stephan
(74) *Attorney, Agent, or Firm* — Frost Brown Todd LLC

(57) ABSTRACT

A structural framing member comprises a web flanked by a pair of flanges. The flanges may extend generally perpendicularly from the side edges of the web. In some embodiments, the web may comprise a plurality of evenly-spaced embossments positioned along the centerline of the web. The embossments may be diamond shaped. The web may further comprise one or more longitudinally extending offsets that extend along the length of the web. Each flange may comprise a plurality of evenly-spaced longitudinally extending stiffeners. The longitudinally extending stiffeners may be spaced approximately ⅜" (0.953 cm) apart from each other. In some embodiments, each flange may further comprise a free end, which is bent inwardly to form a return lip along the length of the flange. The return lip may extend generally perpendicularly from the flange and generally parallel to the web. The structural framing member may comprise a stud, track member, or other framing member.

35 Claims, 9 Drawing Sheets

(51) Int. Cl.

| | |
|---|---|
| ***E04B 2/74*** | (2006.01) |
| ***E04B 2/76*** | (2006.01) |
| ***E04B 2/78*** | (2006.01) |
| *E04C 3/04* | (2006.01) |

(56) References Cited

U.S. PATENT DOCUMENTS

| | | | | |
|---|---|---|---|---|
| 2,733,786 | A | 2/1956 | Drake | |
| 3,341,997 | A | 9/1967 | Pestel et al. | |
| 3,415,026 | A | 12/1968 | Tillisch et al. | |
| 3,423,893 | A | 1/1969 | Hyatt | |
| 3,486,281 | A | 12/1969 | Gregoire | |
| 3,536,345 | A | 10/1970 | Leifer | |
| 3,623,290 | A | 11/1971 | Downing, Jr. | |
| 3,831,333 | A | 8/1974 | Nelsson et al. | |
| 3,845,601 | A | 11/1974 | Kostecky | |
| 3,925,875 | A | 12/1975 | Doke | |
| 4,011,704 | A | 3/1977 | O'Konski | |
| 4,016,700 | A | 4/1977 | Blomstedt | |
| 4,018,020 | A | 4/1977 | Sauer et al. | |
| 4,112,636 | A * | 9/1978 | Hays | 52/98 |
| D257,639 | S | 12/1980 | Reid et al. | |
| 4,329,824 | A | 5/1982 | Lowe | |
| 4,513,551 | A | 4/1985 | Gauffin | |
| 4,713,921 | A | 12/1987 | Minialoff | |
| 4,793,113 | A | 12/1988 | Bodnar | |
| 4,809,476 | A | 3/1989 | Satchell | |
| 4,850,169 | A | 7/1989 | Burkstrand et al. | |
| 4,858,399 | A | 8/1989 | Salato, Jr. | |
| 5,157,883 | A | 10/1992 | Meyer | |
| 5,222,335 | A | 6/1993 | Petrecca | |
| 5,274,973 | A | 1/1994 | Liang | |
| 5,285,615 | A | 2/1994 | Gilmour | |
| 5,315,804 | A | 5/1994 | Attalla | |
| 5,325,651 | A | 7/1994 | Meyer | |
| 5,394,665 | A | 3/1995 | Johnson | |
| 5,463,837 | A | 11/1995 | Dry | |
| 5,527,625 | A | 6/1996 | Bodnar | |
| 5,570,558 | A | 11/1996 | Persson | |
| 5,687,538 | A | 11/1997 | Frobosilo | |
| 5,689,990 | A | 11/1997 | Deeley | |
| 5,797,233 | A | 8/1998 | Hascall | |
| D404,151 | S | 1/1999 | Reichel | |
| 5,927,041 | A | 7/1999 | Sedlmeier | |
| 6,092,349 | A * | 7/2000 | Trenerry | 52/846 |
| 6,183,879 | B1 | 2/2001 | Deeley | |
| 6,199,336 | B1 * | 3/2001 | Poliquin | 52/489.1 |
| 6,205,740 | B1 | 3/2001 | Ekerholm | |
| 6,301,854 | B1 | 10/2001 | Daudet | |
| 6,381,916 | B1 | 5/2002 | Maisch et al. | |
| 6,647,675 | B1 | 11/2003 | Castellanos | |
| 6,701,689 | B2 | 3/2004 | diGirolamo | |
| D618,365 | S | 6/2010 | Crane | |
| 7,849,640 | B2 * | 12/2010 | Rice | 52/105 |
| 8,056,303 | B2 * | 11/2011 | Frobosilo | 52/852 |
| 2002/0023402 | A1 | 2/2002 | Winchester | |
| 2003/0145537 | A1 * | 8/2003 | Bailey | 52/210 |
| 2003/0196401 | A1 | 10/2003 | Surowiecki | |
| 2004/0093822 | A1 | 5/2004 | Anderson | |
| 2005/0081477 | A1 | 4/2005 | St. Quinton | |
| 2006/0016148 | A1 | 1/2006 | Anderson | |
| 2006/0185315 | A1 | 8/2006 | Walker | |
| 2006/0191236 | A1 | 8/2006 | Surowiecki | |
| 2007/0056245 | A1 | 3/2007 | Edmondson | |
| 2007/0068113 | A1 * | 3/2007 | St. Quinton | 52/731.1 |
| 2007/0175149 | A1 * | 8/2007 | Bodnar | 52/481.1 |
| 2007/0193202 | A1 | 8/2007 | Rice | |
| 2008/0006002 | A1 | 1/2008 | Strickland et al. | |
| 2008/0110126 | A1 | 5/2008 | Howchin | |
| 2008/0115445 | A1 | 5/2008 | Keys | |
| 2008/0250738 | A1 | 10/2008 | Howchin | |
| 2009/0013633 | A1 | 1/2009 | Aubuchon | |
| 2009/0090081 | A1 | 4/2009 | Knauf | |
| 2009/0113846 | A1 * | 5/2009 | Knauf | 52/846 |
| 2009/0126315 | A1 * | 5/2009 | Knauf | 52/846 |
| 2009/0178369 | A1 | 7/2009 | Pilz et al. | |
| 2009/0223167 | A1 | 9/2009 | Anderson | |
| 2009/0249743 | A1 | 10/2009 | Bodnar | |

FOREIGN PATENT DOCUMENTS

| | | |
|---|---|---|
| CA | 2584677 | 10/2008 |
| DE | 3 442 355 | 1/1986 |
| EP | 0374316 A1 | 6/1990 |
| EP | 0374316 B1 | 3/1993 |
| EP | 0 638 758 | 2/1995 |
| FR | 2 713 684 | 6/1995 |
| GB | 2 171 731 | 9/1986 |
| WO | WO 2007/134436 | 11/2007 |
| WO | WO 2008/086818 | 7/2008 |

OTHER PUBLICATIONS

Abstract of German Application DE3442355 filed Jan. 2, 1986.
Abstract of European Application EP 0638758 filed Feb. 15, 1995.
Abstract of French Application FR 2713684 filed Jun. 16, 1995.

* cited by examiner

STRUCTURAL FRAMING MEMBER

PRIORITY

This application claims priority to PCT Application No. PCT/US10/45609, filed Aug. 16, 2010, entitled "Improved Structural Framing Member," which claims priority to U.S. Provisional Patent Application Ser. No. 61/234,084, filed Aug. 14, 2009, entitled "Improved Structural Framing Member," the disclosure of which is incorporated by reference herein.

BACKGROUND

In cold-formed steel framing one may use very thin structural framing members to form the interior of structures. The structural framing members may comprise "c-shaped" channels with thicknesses less than about 0.035" (0.089 cm) in metal thickness. While these structural framing members may have sufficient strength for their application in interior walls, ceilings, soffits, etc., their relatively small thicknesses may create difficulty during installation. Handling of the structural framing members may become increasingly difficult because of the twist and bow created by the weight of the structural framing members as the length of the structural framing members increases. By way of example only, this difficulty may increase in structural framing members having lengths of 15 feet (4.572 meters) or greater.

Additionally, when installing other components, such as gypsum panels, the structural framing members may flex. The flexing of structural framing members may make it difficult to install fasteners to connect the components to the structural framing members. Specifically, in structural framing members comprising c-shaped channels the fasteners may be installed in the flanges (legs) of the channel. Due to the relatively small thickness of the cross-section of the structural framing member, the flanges may flex under the force applied by the fastener during installation. In addition, the web portion of the c-shaped channel may also flex during fastener installation. Flexing of the web portion may significantly contribute to rotation of the flanges during fastener installation.

While numerous types of structural framing members have been made and used, it is believed that no one prior to the inventors has made or used the invention described herein.

BRIEF SUMMARY

Embodiments of the present invention may include structural framing members having increased stiffness to help prevent deflection and/or improve performance during handling and installation. Some embodiments may include diamond or other shaped embossments regularly spaced in the web portion of the structural framing member. Some embodiments may also include one or more longitudinally extending stiffeners formed in the flanges of the structural framing member. Still other embodiments may include one or more longitudinally extending offsets formed in the web of the structural framing member.

BRIEF DESCRIPTION OF THE DRAWINGS

While the specification concludes with claims that particularly point out and distinctly claim the invention, it is believed the present invention will be better understood from the following description taken in conjunction with the accompanying drawings, in which like reference numerals identify the same elements. The drawings and detailed description which follow are intended to be merely illustrative and are not intended to limit the scope of the invention as set forth in the appended claims.

DETAILED DESCRIPTION

The following description should not be used to limit the scope of the present invention. Other examples, features, aspects, embodiments, and advantages of the invention will become apparent to those skilled in the art from the following description, which includes by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive. It should therefore be understood that the inventor contemplates a variety of embodiments that are not explicitly disclosed herein.

As used herein, the term "structural framing member" shall be read to include, but not be limited to studs, track members, runners and other framing members used to form part of a structure, including both load-bearing and non-load bearing portions of a structure.

It will be appreciated that the dimensions and specifications provided in the written description in this application are merely examples of suitable dimensions and specifications. In addition to any specific ranges disclosed herein, the disclosed dimensions may vary within generally accepted manufacturing tolerances, including those in accordance with ASTM C645 and IBC 2006, which are well-known to those of ordinary skill in the art. The disclosed dimensions and specifications should not be used to limit the scope of the present invention. The inventors have contemplated that structural framing members embodying the present invention may have any suitable dimensions and specifications. By way of example only, the width of the flanges, the depth of webs, the depth of the return lips, the general radii, the corner dimensions and the thickness of the structural framing members may be varied in different embodiments.

Figure 14:
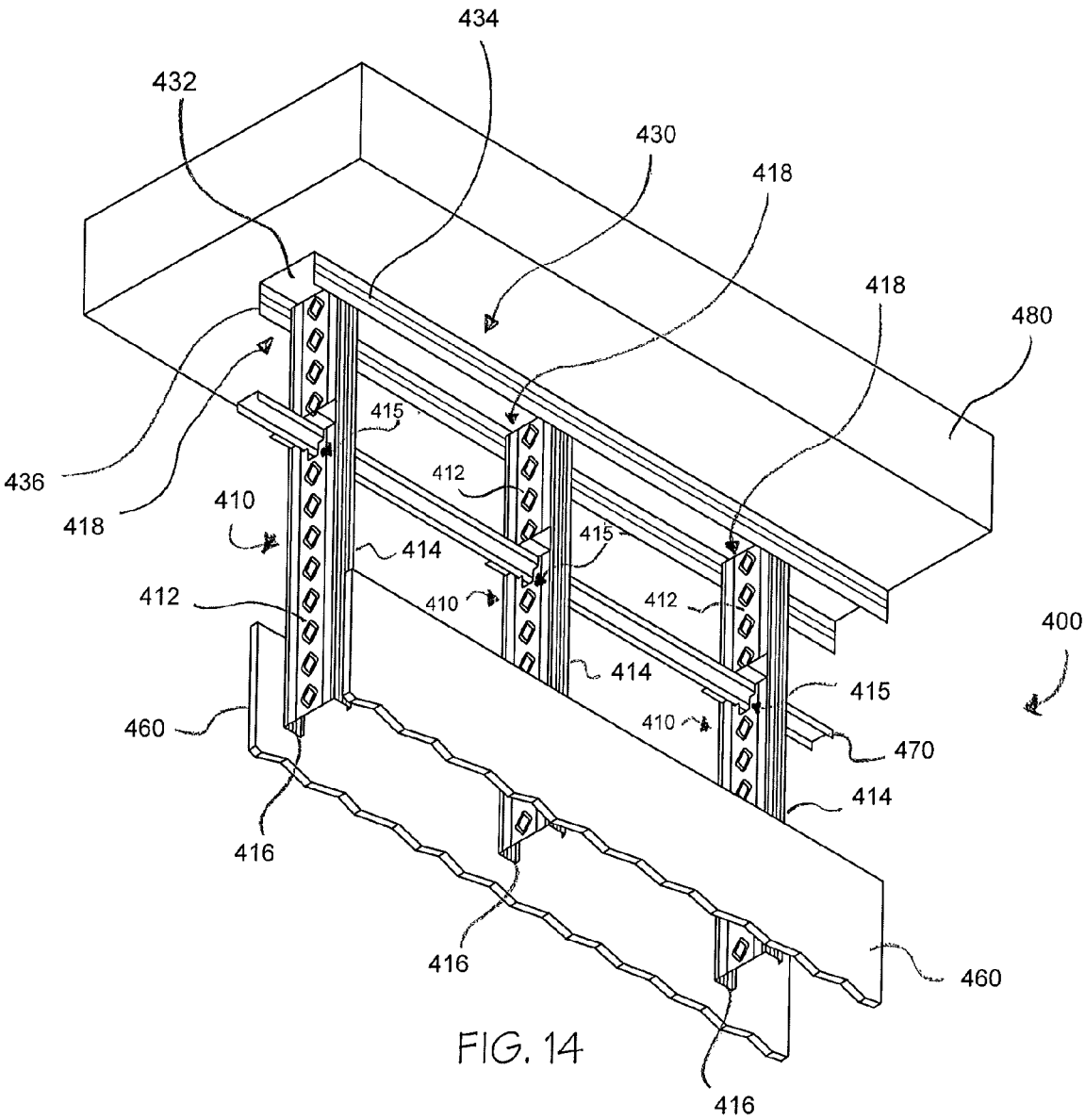
FIG. 14 depicts a partial, detailed perspective view of an alternate exemplary framing assembly incorporating exemplary studs and an exemplary track member.

FIGS. 1-5 depict an exemplary embodiment of a stud 10. In the illustrated embodiment, the stud comprises a c-shaped member that includes a base portion flanked on opposite sides by a pair of flanges 14, 16, and a pair of return lips 18, 20. As shown, the base portion defines a web 12. In various embodiments, the juncture of web 12 with each flange 14, 16 may comprise a radius between about 0.020" (0.051 cm) and about 0.100" (0.254 cm), and preferably in one embodiment the juncture may comprise a radius of about 0.040" (0.102 cm), although this is not required and other suitable radii may be used in other embodiments. The basic shape and cross-section of the stud 10 may follow the industry described c-stud and tracks (runners) as exemplified by the samples shown in the Steel Stud Manufacturer's Association's technical catalog and ASTM C645-09A. The material thickness of stud 10 may range from about 0.0145" (0.037 cm) to about 0.0346" (0.088 cm), or any other suitable dimension depending on the particular application in which the stud is being used. In various embodiments, the material thickness of stud 10 may be about 0.0150" (0.038 cm), about 0.0179" (0.045 cm), about 0.022" (0.056 cm), about 0.026" (0.066 cm), about 0.0296" (0.075 cm), or about 0.0329" (0.084 cm). The depth of web 12 may correspond to the outside depth D of stud 10. By way of example only, in a stud having a nominal outside depth D of about 3½" (8.890 cm), the depth of the web may be about 3½" (8.890 cm). The nominal outside depth D of stud 10 may preferably range from about 1⅝" (4.128 cm) to about 6" (15.240 cm), although the outside depth is not required to be within this range. In various embodiments, the nominal outside depth D of stud 10 may comprise about 1⅝" (4.128 cm), about 2½" (6.350 cm), about 3½" (8.890 cm), about 3⅝" (9.208 cm), about 4" (10.160 cm), about 5½" (13.970 cm), or about 6" (15.240 cm). In some embodiments, the stud may include one or more punchouts or openings in the web configured to allow wiring, pipes, conduits, structural framing members, or other members or materials to be passed through one or more studs in a framing assembly. One such embodiment is shown in FIG. 14 and described in more detail below. Of course, the shape, size and location of the punchouts may vary depending on the particular application of the stud.

Each flange 14, 16 may have an outside width W between about 1" (2.540 cm) and about 1.625" (4.128 cm), and preferably a width W of about 1¼" (3.175 cm). Other suitable widths W may be used depending on the particular application for a particular stud. One or both flanges 14, 16 may include a knurled portion, although this is not required. In some embodiments, the knurled portion may include 7 or 9 rows of knurling, although any suitable amount of knurling may be used.

Each return lip 18, 20 may comprise a depth d of about ⅛" (0.318 cm) to about ½" (1.270 cm) or any other depth appropriate for a particular application using the stud. In a preferred embodiment, each return lip 18, 20 comprises a depth d of about ¼" (0.635 cm). As shown, each flange 14, 16 extends generally perpendicularly from a respective side edge of the web 12. Preferably, the angle between each flange 14, 16 and the web 12 ranges from about 85 degrees to about 95 degrees, and even more preferably the angle between each flange 14, 16 and web 12 is about 90 degrees, although this is not required. Each flange 14, 16 comprises a free end that is bent inwardly to form the pair of return lips 18, 20. In this embodiment, the return lips 18, 20 are formed such that each return lip 18, 20 extends generally parallel to the web 12 and generally perpendicular to the flange 14, 16. Of course, other suitable configurations for return lips 18, 20 may be used depending on the particular application in which the stud is being used. Preferably, the angle between each return lip 18, 20 and its respective flange 14, 16 ranges from about 45 degrees to about 100 degrees, and even more preferably the angle between each return lip 18, 20 and its respective flange 14, 16 is about 90 degrees, although this is not required. The corners of stud 10 may be curved with maximum inside radii ranging from about 0.020" (0.051 cm) to about 0.100" (0.254 cm). In a preferred embodiment, the maximum inside radii for the corners of stud 10 may be about 0.040" (0.102 cm), however any other suitable maximum radii may be used depending on the particular application in which the stud is being used.

Each flange 14, 16 may be configured to receive building materials, such as gypsum panels, during construction of a building or other structure. An embodiment of a framing system 400 comprising panels 460 attached to flanges 414, 416 of a plurality of studs 410 is shown in FIG. 14 and described in more detail below. Panels 460 may comprise gypsum or any other suitable material. The gypsum panels may be approximately 48" (121.920 cm) wide and may be attached to structural framing members spaced at about 8" (20.320 cm), about 12" (30.480 cm), about 16" (40.640 cm), about 19.2" (48.786 cm), about 24" (60.960 cm), or about 48" (121.920 cm) on center. During installation of the gypsum panels, the edge of each panel may be adjoined to the edge of an adjacent panel along a structural framing member. According to an industry standard for gypsum panel installation (ASTM C840), the panels should be fastened by screws with a minimum edge distance (i.e. the distance from the fastener to the edge of the panel) of about ⅜" (0.953 cm).

Figure 1:
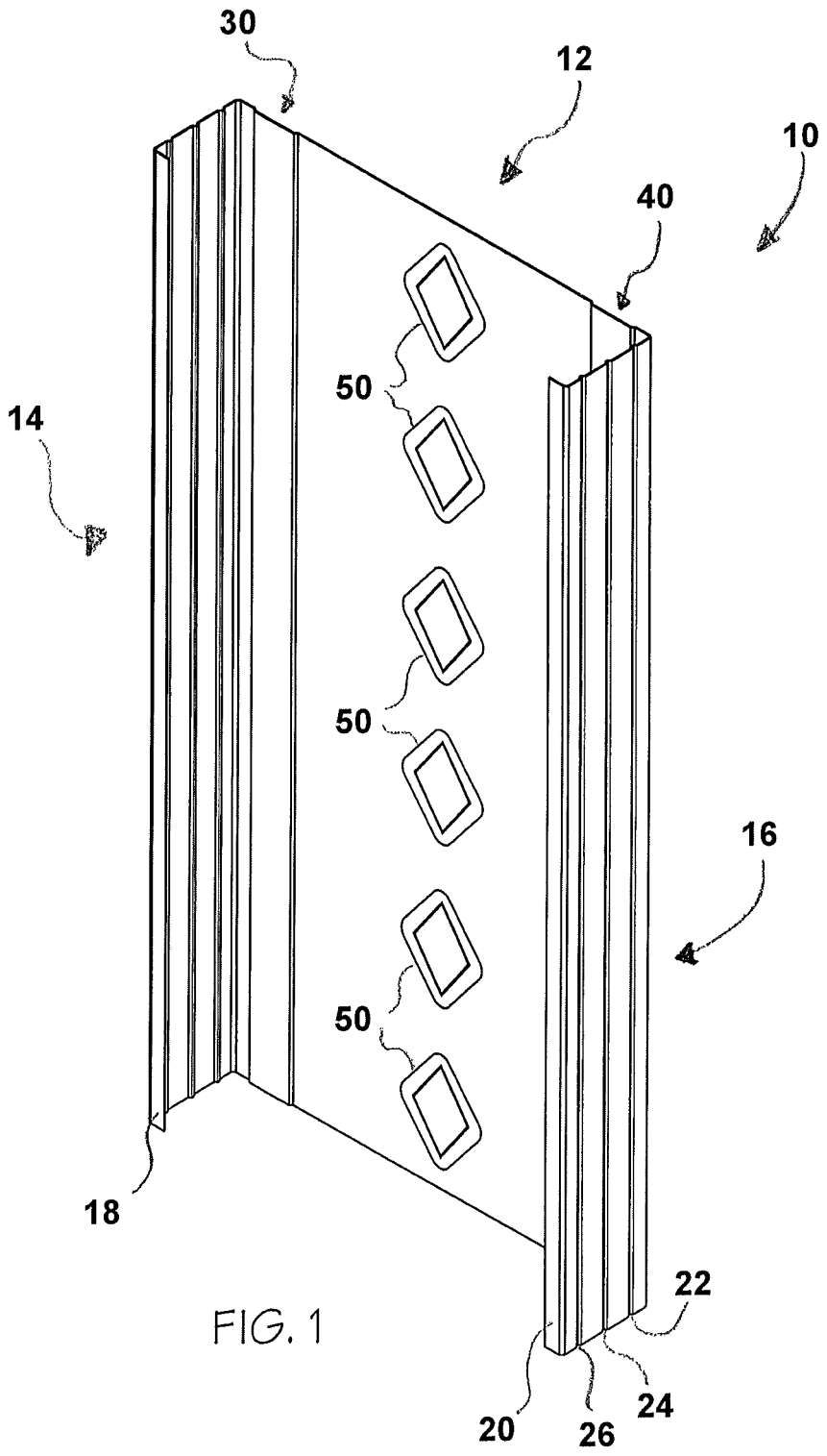
FIG. 1 depicts a perspective view of an exemplary stud.
Figure 2:
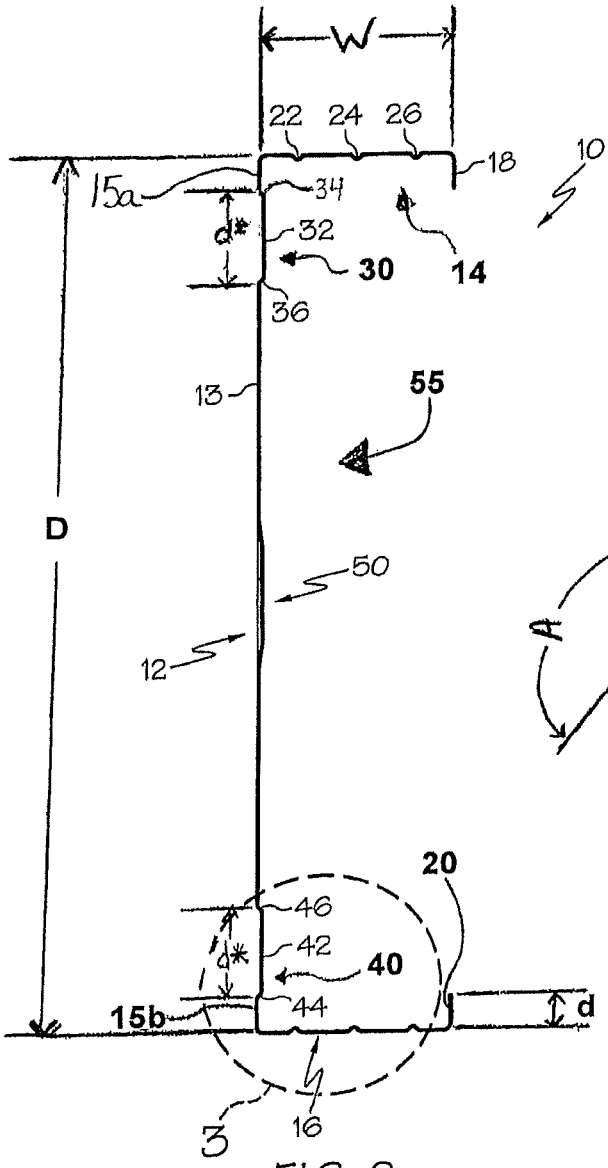
FIG. 2 depicts a front end view of the stud of FIG. 1.
Figure 3:
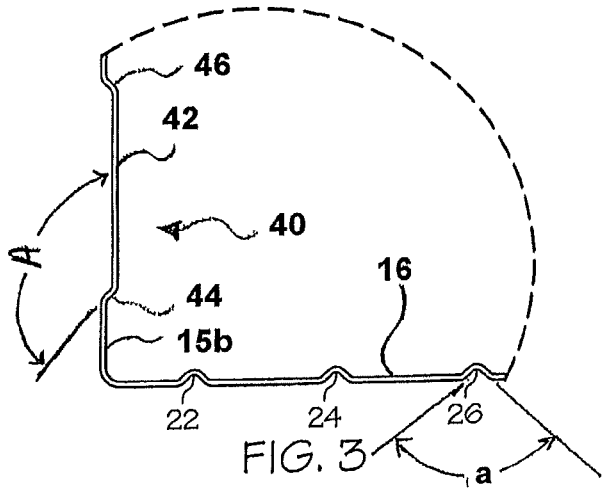
FIG. 3 depicts a detailed view of a portion of the stud of FIG. 1 (portion indicated with dashed circle in FIG. 2).
Figure 4:
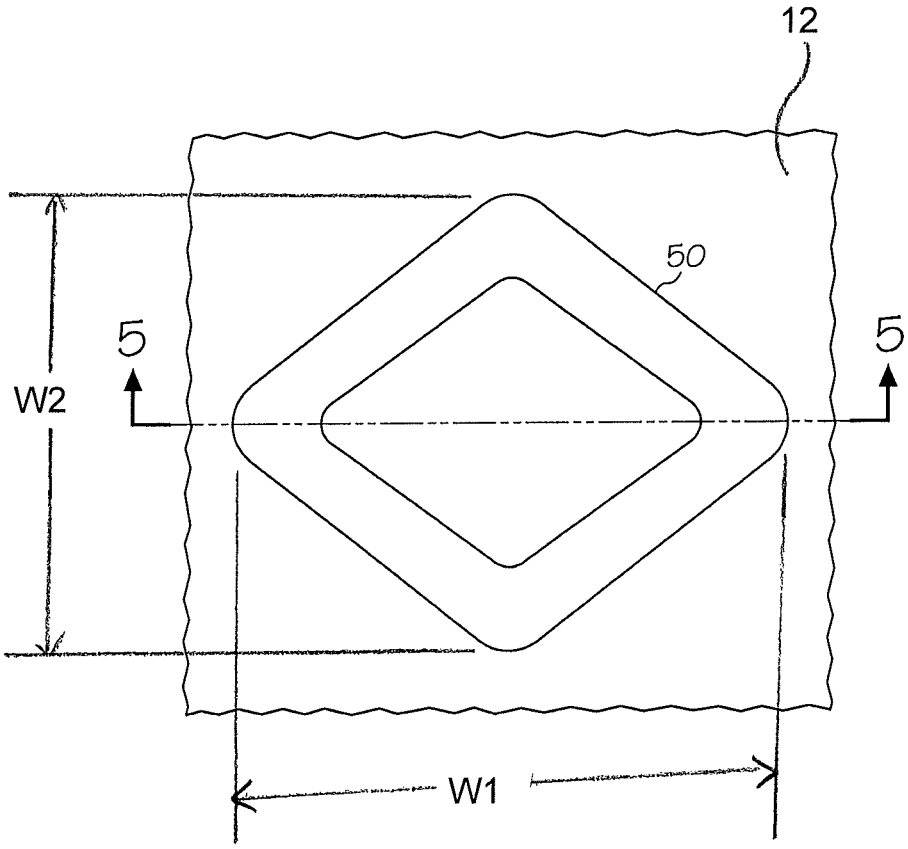
FIG. 4 depicts a top view of an exemplary embossment for the stud of FIG. 1.
Figure 5:
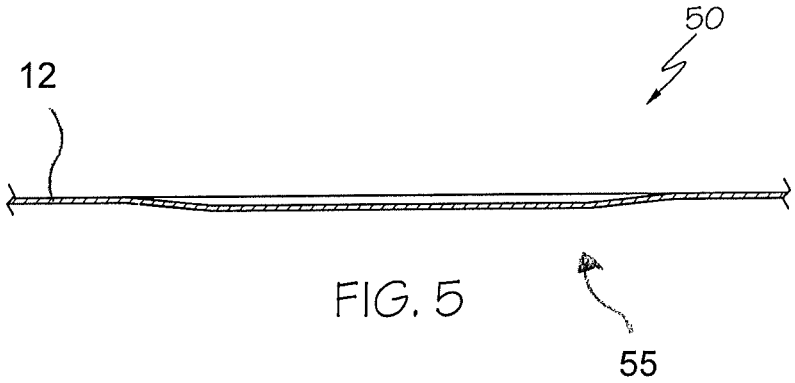
FIG. 5 depicts a detailed cross-sectional view of the embossment of FIG. 4 taken along line 5-5 in FIG. 4.

As shown in FIGS. 1-3, each flange 14, 16 comprises three generally equally-spaced, longitudinally extending stiffeners 22, 24, 26 which are longitudinal ribs formed in each flange 14, 16 that have an arcuate cross-section. In one embodiment, longitudinally extending stiffeners 22, 24, 26 may comprise a radius between about 0.020" (0.051 cm) and about 0.040" (0.102 cm), and preferably a radius of about 0.030" (0.076 cm). In addition, longitudinally extending stiffeners 22, 24, 26 may comprise a height (i.e. the distance from the lowest point of the longitudinally extending stiffener 22, 24, 26 to the outer surface of the respective flange 14, 16) within a range from about 0.020" (0.051 cm) to about 0.040" (0.102 cm), and preferably a height of about 0.030" (0.076 cm). In addition, longitudinally extending stiffeners 22, 24, 26 may be configured to form an angle a within a range of about 45 degrees to about 115 degrees, and preferably an angle a of about 90 degrees. Of course, other suitable configurations, radii and angles for the longitudinally extending stiffeners may be used in alternate embodiments depending on the intended use of the particular stud being fabricated. The shape and dimensions of longitudinally extending stiffeners 22, 24, 26 may be selected so that longitudinally extending stiffeners 22, 24, 26 help prevent a fastener, such as a screw, from sliding during installation. If longitudinally extending stiffeners 22, 24, 26 are too high or wide, they may inhibit installation by allowing a fastener to drag during insertion through flange 14, 16. In addition, if longitudinally extending stiffeners 22, 24, 26 have a height that is too large, then that may result in difficulties during fabrication. To the contrary, the shape and dimensions of longitudinally extending stiffeners 22, 24, 26 may be selected so that longitudinally extending stiffeners 22, 24, 26 provide adequate stiffness in flanges 14, 16 while avoiding significant problems during fabrication, such as tearing or damaging the material. By way of example only, the shape and ranges of dimensions described above may allow longitudinally extending stiffeners 22, 24, 26 to meet these criteria.

The criteria for determining appropriate shapes and dimensions for longitudinally extending stiffeners 22, 24, 26 will be known to those of ordinary skill in the art.

It will be appreciated that alternate embodiments may comprise alternate numbers of longitudinally extending stiffeners and/or longitudinally extending stiffeners with other cross-sections depending on the particular application in which the stud is being used. By way of example only, alternate cross-sections of the longitudinally extending stiffeners may include but are not limited to semi-circular, square, and other curved shapes. In this embodiment, longitudinally extending stiffeners 22, 24, 26 each comprise similar cross-sections. In other embodiments, at least one of the longitudinally extending stiffeners may comprise a different cross-section from at least one other longitudinally extending stiffener. Longitudinally extending stiffeners 22, 24, 26 may extend generally along the entire length of the flange 14, 16, or, alternatively along a portion that is less than the entire length of the flange 14, 16. As shown, longitudinally extending stiffeners 22, 24, 26 are generally parallel to each other. In other embodiments (not shown), two or more longitudinally extending stiffeners may comprise a generally non-parallel configuration such that the longitudinal axes of two or more longitudinally extending stiffeners intersect with each other. In the illustrated embodiment, longitudinally extending stiffeners 22, 24, 26 are generally continuous, linear stiffeners. In other embodiments (not shown), one or more longitudinally extending stiffeners may comprise a generally non-continuous (e.g. broken) or non-linear (e.g. curvilinear) stiffener. In this embodiment, longitudinally extending stiffeners 22, 24, 26 extend either generally along or generally parallel to the longitudinal axis of the respective flange 14, 16. In other embodiments (not shown), one or more longitudinal flanges may be oriented at an angle to the longitudinal axis of the respective flanges. In addition, the depth and radii of longitudinally extending stiffeners 22, 24, 26 may vary based on the particular application in which the stud is being used.

In this embodiment, the closed portion of each longitudinally extending stiffener 22, 24, 26 extends inwardly from the flange 14, 16 towards interior cavity 55 and the opening of each longitudinally extending stiffener 22, 24, 26 is outwardly oriented. In an alternate embodiment, each longitudinally extending stiffener may be configured such that the closed portion of each longitudinally extending stiffener extends outwardly from the flange, and the opening of each longitudinally extending stiffener is inwardly oriented toward the interior cavity of the stud. In yet another alternate embodiment including two or more longitudinally extending stiffeners, at least one longitudinally extending stiffener may be configured such that its closed portion extends outwardly from the flange and its opening is inwardly oriented toward the interior cavity of the stud, while at least one other longitudinally extending stiffener is configured such that its closed portion extends inwardly from the flange toward the interior cavity of the stud and its opening is outwardly oriented.

In some embodiments, the longitudinally extending stiffener 22 closest to web 12 may be spaced apart from web 12 a distance within the range of about 0.125" (0.318 cm) to about 0.375" (0.953 cm). In addition, in some embodiments, the longitudinally extending stiffeners 22, 24, 26 may each be spaced apart from each other a distance within the range of about 0.25" (0.635 cm) to about 0.75" (1.905 cm). In the illustrated embodiment, the longitudinally extending stiffener 22 closest to web 12 is spaced apart from web 12 a distance of about ¼" (0.635 cm) and the longitudinally extending stiffeners 22, 24, 26 are each spaced approximately ⅜" (0.953 cm) apart from each other, but other spacing may be utilized depending on the particular application. The spacing of the longitudinally extending stiffeners 22, 24, 26 may facilitate installation of panels or other building materials. For example, in this embodiment, the center of the middle longitudinally extending stiffener 24 corresponds to the longitudinal centerline of each flange 14, 16. As a result, during installation of panels, users can ensure that the joint between adjacent panels is aligned with the longitudinal centerline of the respective flange 14, 16 by aligning the adjacent edges of the panels with the middle longitudinally extending stiffener 24. Of course, this particular spacing, arrangement and alignment is not required.

Once the panels are aligned with the longitudinal centerline of the respective flange 14, 16, then the panels may be fastened to the respective flange 14, 16 using fasteners, such as screws, aligned with each of the two outside longitudinally extending stiffeners 22, 26. The cross-sectional shape of the two outside longitudinally extending stiffeners 22, 26 may be configured to help grab the tips of fasteners as the tips pierce the panel and contact the flange 14, 16, thereby directing the tips of the fasteners toward the lowest point of the respective longitudinally extending stiffener 22, 26. In addition, the longitudinal shape of each longitudinally extending stiffener may also provide added flexibility by facilitating insertion of fasteners along the entire length of the flange, or at least along the length of the longitudinally extending stiffener, as opposed to prior art dimples which require more precise placement of the fastener tip in order for the dimple to grasp the tip and aid in insertion through the flange. Aligning the fasteners with the two outside longitudinally extending stiffeners 22, 26 may allow each fastener to be placed a consistent distance from the edge of its respective panel, such as the ⅜" (0.953 cm) minimum edge distance as prescribed in the ASTM regulation described above. In this manner, the middle longitudinally extending stiffener 24 may serve as a locator during installation of panels and the adjacent outside longitudinally extending stiffeners 22, 26 may provide controls for the fastener installation. In situations where intermediate fasteners are used during installation, such as when the fasteners are installed at a standard spacing of 12" (30.480 cm) on center per ASTM C840, the middle longitudinally extending stiffener 24 may help align the panel with the longitudinal centerline of a respective flange 14, 16.

Longitudinally extending stiffeners 22, 24, 26 in the flanges 14, 16 of the stud 10 may increase the overall stiffness of the stud 10 by placing more material away from the center of gravity, thereby increasing the second moment of inertia of the final product. In other words, as material is shifted away from the central or neutral axis of the stud 10, the stiffness of the stud 10 may be increased. In addition, longitudinally extending stiffeners 22, 24, 26 may also help reduce local buckling, which is a common mode of failure for C-shaped structural framing members, by increasing the section modulus in the same manner that they increase the second moment of inertia. Specifically, longitudinally extending stiffeners 22, 24, 26 may help reduce or restrain local buckling and increase the strength of stud 10 by decreasing the width of the flat area on each flange 14, 16 so that local wave action is restrained. In addition, if longitudinally extending stiffeners 22, 24, 26 are cold formed, then that process may work-harden the steel, which may increase the yield strength of the material and give stud 10 increased strength. Specifically, longitudinally extending stiffeners 22, 24, 26 comprising dimensions within the ranges described above or meeting the other criteria discussed above may provide adequate stiffening while avoiding problems during fabrication. The criteria for determining appropriate shapes and dimensions for longitudinally extending stiffeners 22, 24, 26 will be known to those of ordinary skill in the art.

In the illustrated embodiment, web 12 of stud 10 comprises two longitudinally extending offsets 30, 40 positioned adjacent to the outside sections 15*a*, 15*b* of the web 12. In various embodiments, each outside section 15*a*, 15*b* may comprise a depth (i.e. the distance between the respective flange 14, 16 and the respective incline portion 34, 44) within the range of about 0.125" (0.318 cm) to about ½" (1.27 cm). In a preferred embodiment, outside sections 15*a*, 15*b* may each comprise a depth of about ¼" (0.635 cm). Of course, outside sections 15*a*, 15*b* may comprise other suitable dimensions in other embodiments. While the illustrated embodiment comprises two longitudinally extending offsets, the number of longitudinally extending offsets may vary based on the particular application in which the stud is being used. The longitudinally extending offsets 30, 40 may extend generally along the entire length of the web 12, or, alternatively, along a portion that is less than the entire length of the web 12. In various embodiments, lontigitudinally extending offsets 30, 40 may comprise an overall depth d* within the range of about ¼" (0.635) to about 1" (2.540 cm). In a preferred embodiment, longitudinally extending offsets 30, 40 may comprise an overall depth d* of about ⅝" (1.588 cm). Similarly, longitudinally extending offsets 30, 40 may comprise a height (i.e. the distance from inner surface of outside sections 15*a*, 15*b* to the inner surface of the raised portion 32, 42) within a range from about 0.020" (0.051 cm) to about 0.040" (0.102 cm), and preferably a height of about 0.030" (0.076 cm). Of course, other suitable dimensions for longitudinally extending offsets may be used in other embodiments. The longitudinally extending offsets 30, 40 may be rectangular shaped and have curved corners, as shown in FIGS. 1-3. Alternate shapes and corner configurations will be apparent to those of ordinary skill in the art. In the illustrated embodiment, longitudinally extending offsets 30, 40 comprise similar shapes and corner configurations. In other embodiments, the longitudinally extending offsets may comprise different shapes and/or corner configurations. The longitudinally extending offsets 30, 40 may comprise any suitable depth, width and radii, depending on the particular application in which the stud is being used. If longitudinally extending offsets 30, 40 have a height that is too large, then that may result in difficulties during fabrication. The shape and dimensions of longitudinally extending offsets 30, 40 may be selected so that longitudinally extending offsets 30, 40 provide adequate stiffness in web 12 while avoiding significant problems during fabrication, such as tearing or damaging the material. By way of example only, the shape and ranges of dimensions described above may allow longitudinally extending offsets 30, 40 to provide adequate stiffness in web 12 while avoiding damage to the material during fabrication. The criteria for determining appropriate shapes and dimensions for longitudinally extending offsets 30, 40 will be known to those of ordinary skill in the art.

In this embodiment, the longitudinally extending offsets 30, 40 are inwardly oriented, such that they extend inwardly from the plane of the web 12 toward the interior cavity 55 of the stud 10. In an alternate embodiment, one or more of the longitudinally extending offsets may be outwardly oriented, such that it extends outwardly from the plane of the web away from the interior cavity of the stud. In yet another alternate embodiment including two or more longitudinally extending offsets, at least one longitudinally extending offset may be inwardly oriented, while at least one other longitudinally extending offset may be outwardly oriented. As shown, longitudinally extending offsets 30, 40 are generally parallel to each other. In other embodiments (not shown), the longitudinally extending offsets may be comprise a generally non-parallel configuration such that the longitudinal axes of the longitudinally extending offsets intersect with each other. In the illustrated embodiment, longitudinally extending offsets 30, 40 are generally continuous, linear structures. In other embodiments (not shown), one or more longitudinally extending stiffeners may comprise a generally non-continuous (e.g. broken) or non-linear (e.g. curvilinear) structures. In this embodiment, longitudinally extending offsets 30, 40 extend either generally along or generally parallel to the longitudinal axis of web 12. In other embodiments (not shown), one or more longitudinally extending offsets may be oriented at an angle to the longitudinal axis of the web.

As shown in FIGS. 1-3, the longitudinally extending offsets 30, 40 comprise a raised portion 32, 42 flanked on opposite edges by an incline portion 34, 44 and a return portion 36, 46. In this embodiment, incline portion 34, 44 is the angled section located closest to the side edge of the stud 10, while the return portion 36, 46 is the angled section located towards the centerline of the web 10. In various embodiments, the angle A formed by each incline portion 34, 44 with its respective raised portion 32, 42 is within the range of about 90 degrees to about 150 degrees. In a preferred embodiment, the angle A is about 135 degrees. Each return portion 36, 46 may form a similar angle with its respective flat portion 32, 42, although this is not necessarily required. Of course, in other embodiments, other suitable dimensions for the longitudinally extending offsets may be used. This incline/return configuration creates a central web surface 13 that is generally co-planar with the outer sections 15*a*, 15*b* of web 12. Such a configuration may facilitate attachment of the stud 10 to another stud or structural framing member. For instance if a pair of studs are positioned with the web portions adjacent to each other, the central web portions will abut one another. In configurations without the incline/return configuration, there may be a gap between central web portions when studs are aligned with the web portions adjacent to each other. Of course, this incline/return configuration is not required. In addition, the illustrated configuration, size and placement of offsets 30, 40 and the inclusion of central web surface 13 may also facilitate attachment between a pair of studs forming a corner of a wall framing assembly. In such a framing assembly, the flange of a first stud may abut the central web surface of a second stud, and having offsets that form a central web surface, as shown, may help form a generally 90 degree angle between the first and second studs.

Longitudinally extending offsets 30, 40 may increase the overall stiffness of stud 10 by placing additional mass away from the center of gravity, thereby increasing the second moment of inertia in the strong axis, which is the physical property linked to stiffness. Longitudinally extending offsets 30, 40 may also provide additional strength by locally stiffening the web 12 and increasing the section modulus, which may improve the stud's 10 performance under the failure modes of local and distortional buckling. The strength of the stud 10 may be increased because the formed radius and offsets 30, 40 may increase the strength of the steel and strengthen the plate, which may help prevent a wave from forming in the material of web 12. Overall, the net effect may be increased local buckling strength. Positioning longitudinal offsets 30, 40 as illustrated may reduce local buckling of web 12 because longitudinal offsets 30, 40 are each positioned within a high-stress portion of web 12 near the flange/web intersection. Specifically, longitudinally extending offsets 30, 40 comprising dimensions within the ranges described above or meeting the other criteria discussed above may provide adequate stiffening while avoiding problems during fabrication. The criteria for determining appropriate shapes and dimensions for longitudinally extending offsets 30, 40 will be known to those of ordinary skill in the art.

Longitudinally extending stiffeners 22, 24, 26 and longitudinally extending offsets 30, 40 may be added to stud 10 after embossments 50 (described below) have been formed in web 12, although this is not required. Stud 10 may also undergo roll-forming after embossment.

The embodiments shown in FIGS. 1-5 include a plurality of embossments 50 positioned along the centerline of web 12. In the illustrated embodiment, embossments 50 are positioned along the centerline of web 12 such that each embossment 50 is symmetrical about the centerline. Of course, in other embodiments, one or more embossments may be positioned along the centerline without being symmetrical about the centerline, which may result from the particular shape and/or position of the non-symmetrical embossments. As used herein, the term "embossments" includes but is not limited to raised portions or structures formed by embossing, imprinting, stamping and other similar processes. In various embodiments, embossments 50 may comprise a raised portion that extends a distance above web 12 (i.e. the "height of the embossment"), wherein the height of the embossment is within the range of about 0.020" (0.051 cm) to about 0.050" (0.127 cm). In a preferred embodiment, embossments 50 may comprise a height of about 0.025" (0.064 cm). Of course, other suitable dimensions may be used depending on the particular application involved. In addition, embossments 50 may extend from the flat surface of web 12 at an angle within the range of about 5 degrees to about 15 degrees, although other suitable angles may be used in other embodiments. In a preferred embodiment, embossments 50 may extend from the flat surface of web 12 at an angle of about 6 degrees. Alternate embodiments of studs may comprise embossments positioned somewhere along the web other than along the centerline, while still further embodiments may comprise a generally flat web without embossments. Embossments 50 may be generally evenly spaced along generally the entire length of web 12, or, alternatively, along a portion that is less than the entire length of web 12. In some embodiments, embossments 50 may be un-evenly spaced along at least a portion of web 12. In various embodiments, embossments 50 may be spaced apart a distance within the range from about 1.75" (4.445 cm) to about 4" (10.160 cm). In a preferred embodiment embossments 50 may be spaced about 2" (5.080 cm) apart (center to center), although the spacing may depend on the particular application in which the stud is being used. Also, in this particular embodiment, embossments 50 comprise discrete structures such that adjacent embossments are not connected to each other. Of course, this is not required, and embossments may be connected to each other in some embodiments.

In the illustrated embodiment, embossments 50 are inwardly oriented such that they extend inwardly from the plane of web 12 into interior cavity 55 of stud 10. In an alternate embodiment, the embossments may be outwardly oriented, such that they extend outwardly from the plane of the web away from the interior cavity of the stud. In yet another alternate embodiment including two or more embossments, at least one embossment may be inwardly oriented, while at least one other embossment may be outwardly oriented. In the illustrated embodiment, embossments 50 comprise a diamond shape, although other suitable shapes may be used depending on the particular application in which the stud is being used. By way of example only, alternate embodiments may include, but is not limited to, embossments comprising one or more of the following shapes: diamond shaped, circular, bar-shaped, oval, chevron-shaped, rectangular, hexagonal, z-shaped, and letter-shaped. As shown, embossments 50 are generally identical shapes and sizes. Alternate embodiments may comprise a plurality of embossments wherein at least some of the embossments are different shapes and/or sizes. Embossments 50 may comprise any suitable length, width, depth, and spacing depending on the particular application in which the stud is being used. In various embodiments, each embossment may comprise a longitudinal width w1 within the range of about 1" (2.540 cm) to about 3" (7.620 cm) and a transverse width w2 within the range of about 1" (2.540 cm) to about 2" (5.080 cm). By way of example only, in a preferred embodiment, each embossment 50 may comprise a longitudinal width w1 of about 1 9/16" (3.969 cm) and a transverse width w2 of about 1 1/4" (3.175 cm). In addition, the dimensions of the embossments within a single structural framing member may vary by about 25% without affecting the performance of the structural framing member.

Embossments 50 may help locally stiffen the stud and help prevent deflection, thereby improving the stud's 10 performance during handling and installation. The design of features formed in stud 10, including longitudinally extending stiffeners 22, 24, 26, longitudinally extending offsets 30, 40, and embossments 50, including both the overall shapes and the dimensions of each of these features may be impacted by the type of material used to form stud 10. By way of example only, particular shapes and dimensions for the features may be selected in order to allow the stud 10 to be made out of high strength steels (i.e. steels with yield strengths exceeding about 50 ksi (344.738 MPa)). Of course, this is not required and stud 10 may be made out of any suitable material, including but not limited to steel, stainless steel, aluminum, plastics, other polymer-based or reinforced materials, and combinations thereof. By way of example only, the shapes and ranges of dimensions described above for each of the features may allow stud 10 to be made from high strength steels. The height of the features may be limited depending on the material used, because features with large heights may result in cracking of the steel, particularly in high strength steels. The criteria for determining appropriate combinations of shapes and dimensions for features and material for the stud will be known to those of ordinary skill in the art.

High strength steels may be more difficult to form than lower strength steels because the yield strength and tensile strength of high strength steels are typically very close to each other, which can lead to cracking if the steel is overworked during forming. The design of embossments 50 may help prevent this cracking by distributing the stress during forming across a larger area than conventional embossments. In addition, the design of embossments 50 may allow for a more gradual or gentle draw of the steel during foaming, when compared to other shapes, such as a rectangle with sharp corners. Thus the design of embossments 50 allows the steel to be stretched without permitting the steel to collect along the flat areas prior to and after forming. Allowing the steel to collect in one part of the cross-section may result in the formation of waves in stud 10, an effect commonly known as oil canning. By not permitting the steel to collect along the flat areas, the design of embossments 50 may also help prevent waves from forming in the stud 10. As shown, embossments 50 are designed to stretch the steel without permitting the steel to collect along the flat areas prior to and after forming. As a result embossments 50 may locally strengthen stud 10 and improve the rigidity and strength of stud 10, while also allowing the final formed stud 10 to have generally the same length as the original steel strip used to form stud 10. Embossments 50 may stiffen the web 12 to help prevent buckling when a load is applied to stud 10. The load can either be from pressure applied to the flange 14, 16 or overall loads on stud 10 in the form of lateral pressure, twisting or in-plane movement.

In one exemplary embodiment, a stud generally similar to stud 10 described above is manufactured with the following dimensions within generally accepted manufacturing tolerances, including those in accordance with ASTM C645 and IBC 2006, which are well-known to those of ordinary skill in the art:

- Radius of juncture between the web and each flange=about 0.040" (0.102 cm);
- Material thickness=about 0.022" (0.056 cm);
- Nominal outside depth (D) of the stud=about 3⅝" (9.208 cm);
- Outside width (W) of each flange=about 1¼" (3.175 cm);
- Depth (d) of each return lip=about ¼" (0.635 cm);
- Maximum inside radii for corners of the stud=about 0.040" (0.102 cm);
- Radius of each of the longitudinally extending stiffeners=about 0.030" (0.076 cm);
- Height of each of the longitudinally extending stiffeners=about 0.030" (0.076 cm);
- Distance between the web and the closest longitudinally extending stiffener=about ¼" (0.635 cm);
- Spacing between each of the longitudinally extending stiffeners=about ⅜" (0.953 cm);
- Depth of the outside sections (i.e. distance between the flange and the incline portion of each longitudinally extending offset)=about ¼" (0.635 cm);
- Overall depth of each longitudinally extending offset=about ⅝" (1.588 cm);
- Height of each longitudinally extending offset=about 0.030" (0.076 cm);
- Height of the embossments=about 0.025" (0.064 cm);
- Spacing between the embossments=about 2" (5.080 cm);
- Longitudinal width (w1) of each embossment=about 1⁹⁄₁₆" (3.969 cm);
- Transverse width (w2) of each embossment=about 1¼" (3.175 cm);
- Angle between the web and each flange=about 90 degrees;
- Angle between each return lip and its respective flange=about 90 degrees;
- Angle (a) formed by the longitudinally extending stiffeners=about 90 degrees;
- Angle (A) formed by the incline portion and raised portion of each longitudinally extending offset=about 135 degrees; and
- Angle that the embossment extends from the face of the web=about 6 degrees.

Of course, other embodiments may have other suitable dimensions and combinations thereof.

Figure 7:
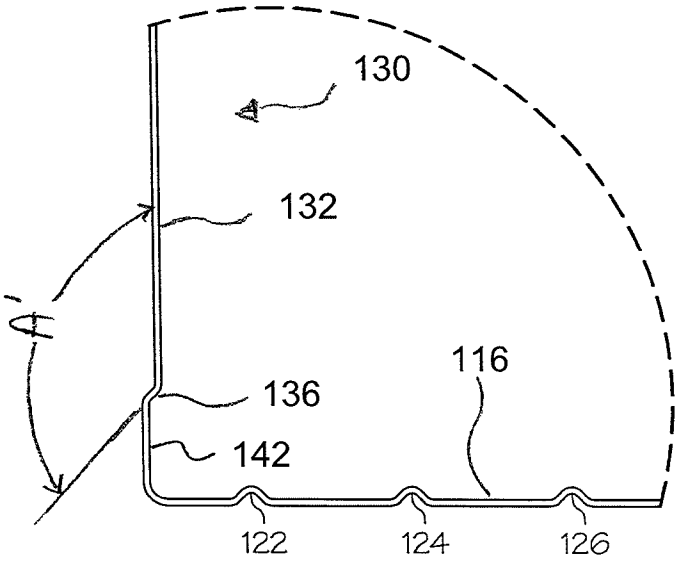
FIG. 7 depicts a detailed view of a portion of the stud of FIG. 6 (portion indicated with dashed circle in FIG. 6).
Figure 6:
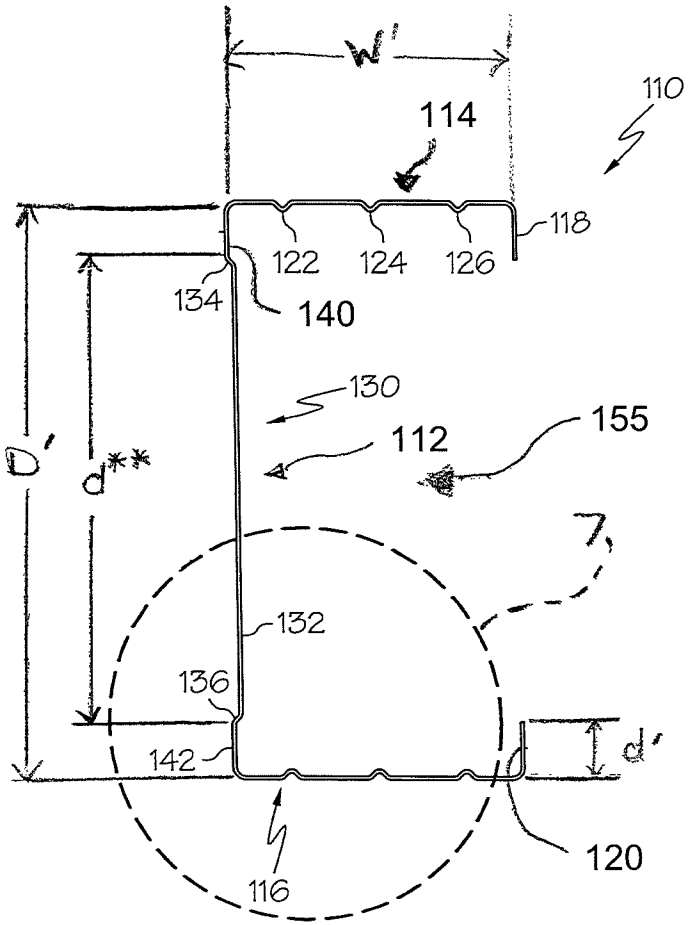
FIG. 6 depicts a front end view of an alternate exemplary stud.
Figure 8:
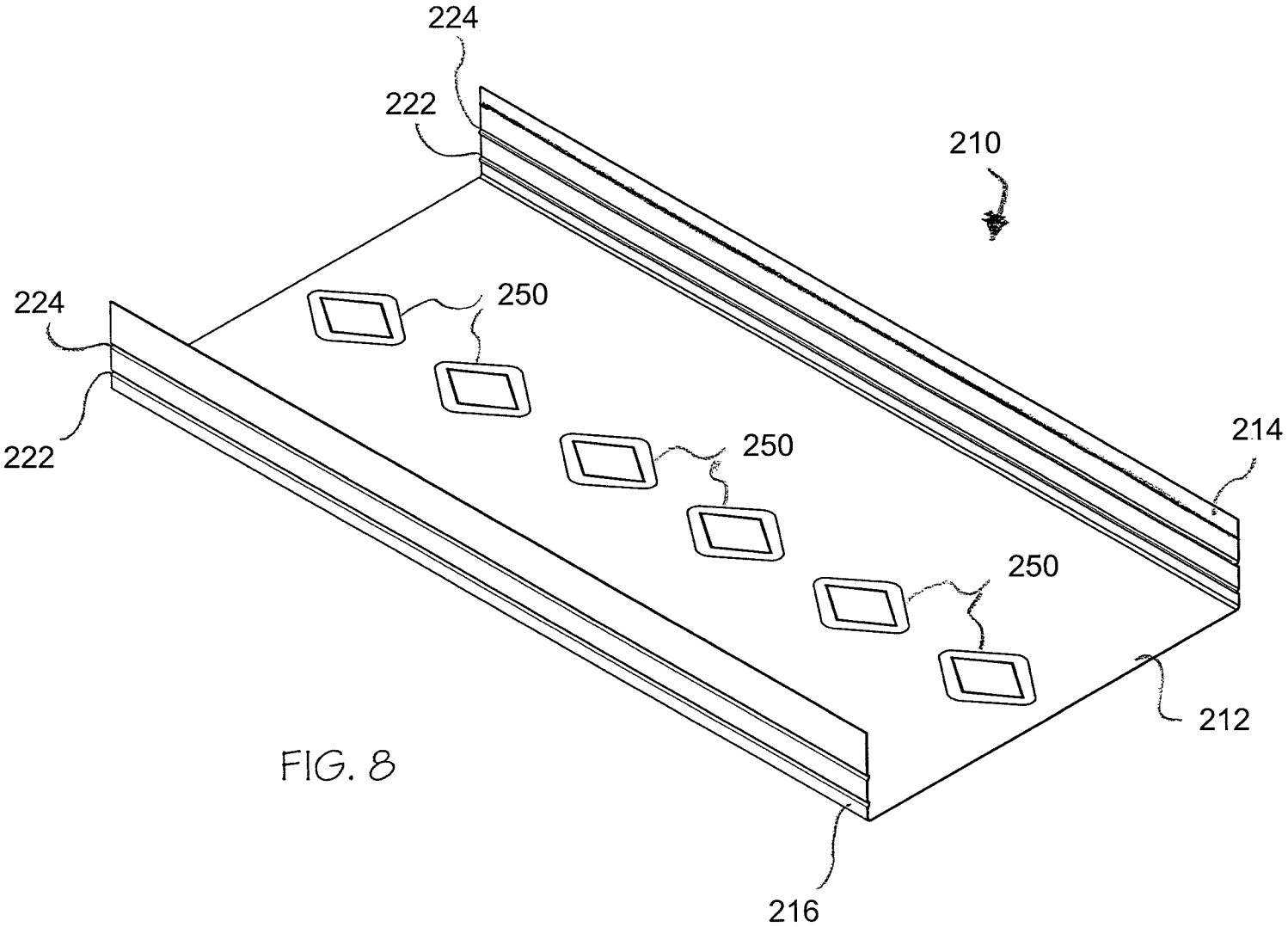
FIG. 8 depicts a perspective view of an exemplary track member.
Figure 10:
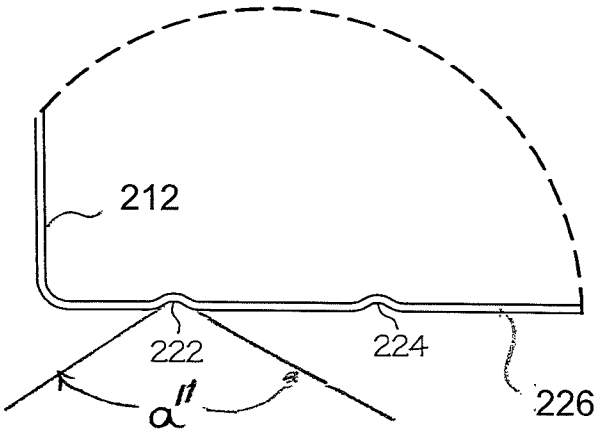
FIG. 10 depicts a detailed view of a portion of the track member of FIG. 8 (portion indicated with dashed circle in FIG. 9).

FIGS. 6-7 depict an alternate embodiment of a stud 110. Similar to the embodiment described above, stud 110 in this embodiment comprises a c-shaped member that includes a base portion flanked on opposite sides by a pair of flanges 114, 116, and a pair of return lips 118, 120. As shown, the base portion defines a web 112. In various embodiments, the juncture of web 112 with each flange 114, 116 may comprise a radius between about 0.020" (0.051 cm) and about 0.100" (0.254 cm), and, preferably in one embodiment the juncture may comprise a radius of about 0.040" (0.102 cm), although this is not required and other suitable radii may be used in other embodiments. The basic shape and cross-section of stud 110 may follow the industry described c-stud and tracks (runners) as exemplified by the samples shown in the Steel Stud Manufacturer's Association's technical catalog and ASTM C645-09A or ASTM C645-04. The material thickness of stud 110 may range from about 0.0145" (0.037 cm) to about 0.0346" (0.088 cm), or any other suitable dimension depending on the particular application in which the stud is being used. In various embodiments, the material thickness of stud 110 may be about 0.0150" (0.038 cm), about 0.0179" (0.045 cm), about 0.022" (0.056 cm), about 0.026" (0.066 cm), about 0.0296" (0.075 cm), or about 0.0329" (0.084 cm). The depth of web 112 may correspond to the outside depth D' of stud 110. By way of example only, in a stud having a nominal outside depth D' of about 1⅝" (4.128 cm), the depth of the web may be about 1⅝" (4.128 cm). The nominal outside depth D' of stud 110 may preferably range from about 1⅝" (4.128 cm) to about 3½" (8.890 cm), although outside depth D' is not required to be within this range. In various embodiments, the nominal outside depth D of stud 110 may comprise about 1⅝" (4.128 cm), about 2½" (6.350 cm), or about 3½" (8.890 cm). In some embodiments, the stud may include one or more punchouts or openings in the web configured to allow wiring, pipes, conduits, structural framing members, or other members or materials to be passed through one or more studs in a framing assembly. One such embodiment is shown in FIG. 14 and described in more detail below. Of course, the shape, size, and location of the punchouts may vary depending on the particular application of the stud.

Each flange 114, 116 may have an outside width W' between about 1" (2.540 cm) and about 1.625" (4.128 cm), and preferably a width W' of about 1¼" (3.175 cm). Other suitable widths W' may be used depending on the particular application for a particular stud. One or both flanges 114, 116 may include a knurled portion, although this is not required. In some embodiments, the knurled portion may include 7 or 9 rows of knurling, although any suitable amount of knurling may be used.

Each return lip 118, 120 may comprise a depth d' of about ⅛" (0.318 cm) to about ½" (1.270 cm) or any other depth appropriate for a particular application using the stud. In a preferred embodiment, each return lip 18, 20 comprises a depth d' of about ¼" (0.635 cm). As shown, each flange 114, 116 extends generally perpendicularly from a respective side edge of the web 112. Preferably, the angle between each flange 14, 16 and the web 12 ranges from about 85 degrees to about 95 degrees, and even more preferably, the angle between each flange 14, 16 and web 12 is about 90 degrees, although this is not required. Each flange 114, 116 comprises a free end that is bent inwardly to form the pair of return lips 118, 120. In this embodiment, the return lips 118, 120 are formed such that each return lip 118, 120 extends generally parallel to the web 112 and generally perpendicular to the flange 114, 116. Preferably, the angle between each return lip 18, 20 and its respective flange 14, 16 ranges from about 45 degrees to about 100 degrees, and even more preferably the angle between each return lip 18, 20 and its respective flange 14, 16 is about 90 degrees, although this is not required. The corners of stud 110 may be curved with maximum inside radii ranging from about 0.020" (0.051 cm) to about 0.100" (0.254). In a preferred embodiment, the maximum inside radii for the corners of stud 110 may be about 0.040" (0.102 cm), however any other suitable maximum radii may be used depending on the particular application in which the stud is being used.

Flanges 114, 116 and longitudinally extending stiffeners 122, 124, 126 in the alternate embodiment shown in FIGS. 6-7 are generally identical to flanges 14, 16 and longitudinally extending stiffeners 22, 24, 26 described above. Therefore, the description of the flanges 14, 16 and longitudinally extending stiffeners 22, 24, 26 provided above also applies to the embodiment shown in FIGS. 6-7 and will not be repeated here. It should be noted that the longitudinally extending stiffener 122 closest to web 112 may be spaced apart from web 112 a distance within the range of about ¼" (0.635 cm) to about ¾" (1.905 cm). However, all other exemplary ranges and dimensions discussed above with regard to longitudinally extending stiffeners 22, 24, 26 in stud 10 also apply to longitudinally extending stiffeners 122, 124, 126 in stud 110.

Web 112 in the embodiment shown in FIGS. 6-7 comprises a single longitudinally extending offset 130 centered along the centerline of the web 112. While the illustrated embodiment comprises one longitudinally extending offset 130, the number of longitudinally extending offsets may vary based on the particular application in which the stud is being used. In this embodiment, raised portion 132 of the longitudinally extending offset 130 extends at least a majority of the depth of the web 112 (i.e. in a direction perpendicular to the longitudinal centerline of the web), however this is not necessarily required. Longitudinally extending offset 130 may extend generally along the entire length of web 112, or, alternatively, along a portion that is less than the entire length of web 12. Longitudinally extending offset 130 may comprise any suitable depth, width and radii depending on the particular application in which the stud is being used. In various embodiments, longitudinally extending offset 130 may comprise an overall depth d within the range of about 1⅛" (2.858 cm) to about 3¼" (8.255 cm). Specifically, in some embodiments, longitudinal offset 130 may comprise an overall depth d of 1⅛" (2.858 cm), 2" (5.080 cm), or about 3" (7.620 cm), but, these particular dimensions are not required. In addition, longitudinally extending offset 130 may comprise a height (i.e. the distance from inner surface of first lower portion 140 or second lower portion 142 to the inner surface of the raised portion 132) within a range from about 0.020" (0.051 cm) to about 0.040" (0.102 cm), and preferably a height of about 0.030" (0.076 cm). Of course, other suitable dimensions for a longitudinally extending offset may be used in other embodiments. The longitudinally extending offset 130 may be rectangular shaped and have curved corners, as shown in FIGS. 6-7. Alternate shapes and corner configurations will be apparent to those of ordinary skill in the art. If longitudinally extending offset 130 has a height that is too large, then that may result in difficulties during fabrication. The shape and dimensions of longitudinally extending offset 130 may be selected so that longitudinally extending offset 130 provides adequate stiffness in web 112 while avoiding significant problems during fabrication, such as tearing or damaging the material. By way of example only, the shape and ranges of dimensions described above may allow longitudinally extending offset 130 to provide adequate stiffness in web 112 while avoiding damage to the material during fabrication. The criteria for determining appropriate shapes and dimensions for longitudinally extending offset 130 will be known to those of ordinary skill in the art.

In the illustrated embodiment, longitudinally extending offset 130 is inwardly oriented, such that it extends inwardly from the plane of the web 12 toward the interior cavity 155 of stud 110. In an alternate embodiment, the longitudinally extending offset may be outwardly oriented, such that it extends outwardly from the plane of the web away from the interior cavity of the stud. In this embodiment, raised portion 132 of longitudinally extending offset 130 is attached to a first lower section 140 via an incline portion 134. The raised portion 132 of the longitudinally extending offset 130 is further attached to a second lower section 142 via a return portion 136. In various embodiments, the angle A' formed by return portion 136 with raised portion 132 is within the range of about 90 degrees to about 150 degrees. In a preferred embodiment, the angle A' is about 135 degrees. Incline portion 134 may form a similar angle with raised portion 132, although this is not necessarily required. Of course, in other embodiments, other suitable dimensions for the longitudinally extending offset may be used. As shown, first lower section 140 and second lower section 142 are respectively positioned near opposite side edges of web 112. In one embodiment, first lower section 140 and second lower section 142 may each comprise a depth (i.e. the distance between the respective flange 114, 116 and either incline portion 134 or return portion 136, respectively) within the range of about 0.125" (0.318 cm) to about ½" (1.270 cm). In a preferred embodiment, first lower section 140 and second lower section 142 may each comprise a depth of about ¼" (0.635 cm). Of course, first lower section 140 and second lower section 142 may comprise other suitable dimensions in other embodiments.

In the embodiment shown in FIGS. 6-7, web 112 is generally flat and does not include any embossments. However, in alternate embodiments, web 112 shown in FIGS. 6-7 may incorporate embossments, such as embossments 50 shown in FIGS. 1-5 and described above, or any other suitable surface treatments depending on the particular application in which the stud is being used. It should be noted that in embodiments of stud 110 incorporating one or more embossments into web 112, the embossments may be dimensioned according to the ranges and preferred dimensions discussed above with regard to embossments 50 in stud 10.

In one exemplary embodiment, a stud generally similar to stud 110 described above, except that the exemplary embodiment includes a plurality of embossments in the web, is manufactured with the following dimensions within generally accepted manufacturing tolerances, including those in accordance with ASTM C645 and IBC 2006, which are well-known to those of ordinary skill in the art:

- Radius of juncture between the web and each flange=about 0.040" (0.102 cm);
- Material thickness=about 0.022" (0.056 cm);
- Nominal outside depth (D) of the stud=about 2½" (6.350 cm);
- Outside width (W) of each flange=about 1¼" (3.175 cm);
- Depth (d) of each return lip=about ¼" (0.635 cm);
- Maximum inside radii for corners of the stud=about 0.040" (0.102 cm);
- Radius of each of the longitudinally extending stiffeners=about 0.030" (0.076 cm);
- Height of each of the longitudinally extending stiffeners=about 0.030" (0.076 cm);
- Distance between the web and the closest longitudinally extending stiffener=about ¼" (0.635 cm);
- Spacing between each of the longitudinally extending stiffeners=about ⅜" (0.953 cm);
- Depth of the lower portions (i.e. distance between the flange and the incline portion and return portion of the longitudinally extending offset)=about ¼" (0.635 cm);
- Overall depth of the longitudinally extending offset=about 2" (5.080 cm);
- Height of the longitudinally extending offset=about 0.030" (0.076 cm);
- Height of the embossments=about 0.025" (0.064 cm);
- Spacing between the embossments=about 2" (5.080 cm);
- Longitudinal width (w1) of each embossment=about 1 9/16" (3.969 cm);
- Transverse width (w2) of each embossment=about 1¼" (3.175 cm);

Angle between the web and each flange=about 90 degrees;

Angle between each return lip and its respective flange=about 90 degrees;

Angle (a) formed by the longitudinally extending stiffeners=about 90 degrees;

Angle (A) formed by the incline portion and raised portion of each longitudinally extending offset=about 135 degrees; and Angle that the embossment extends from the face of the web=about 6 degrees.

Of course, other embodiments may have other suitable dimensions and combinations thereof.

Figure 9:
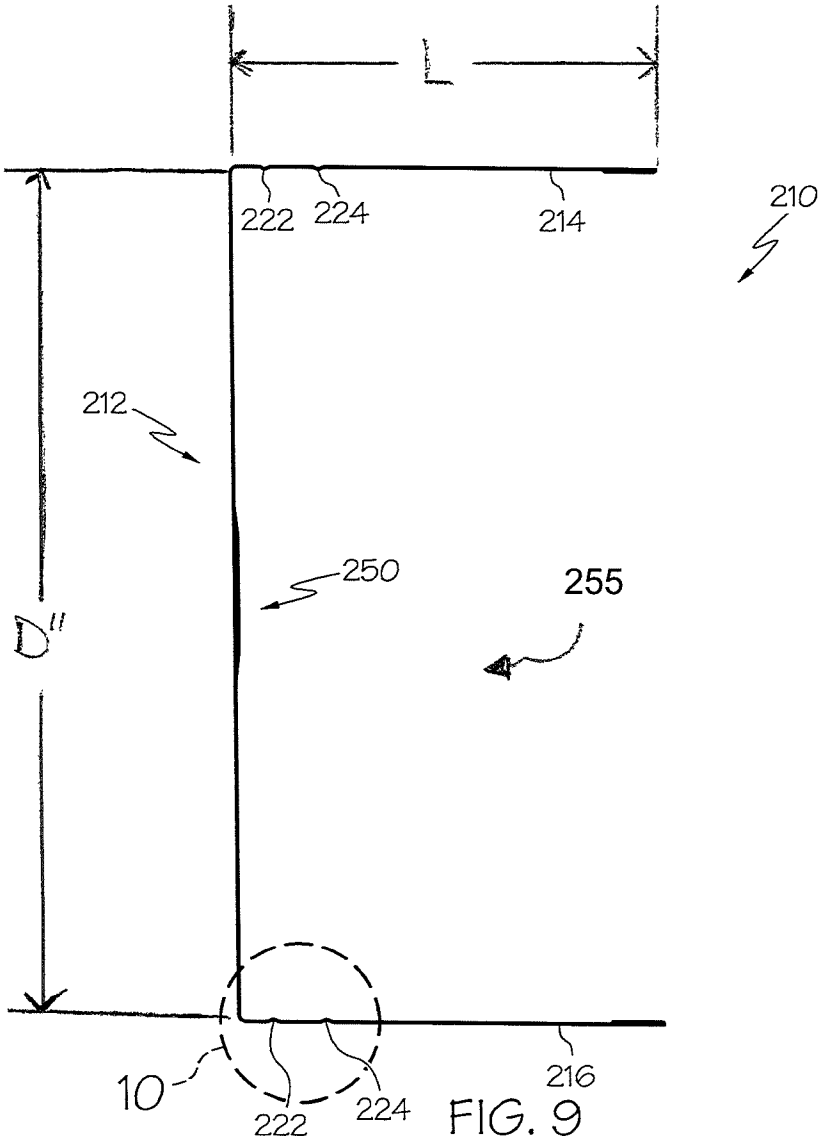
FIG. 9 depicts a front end view of the track member of FIG. 8.
Figure 11:
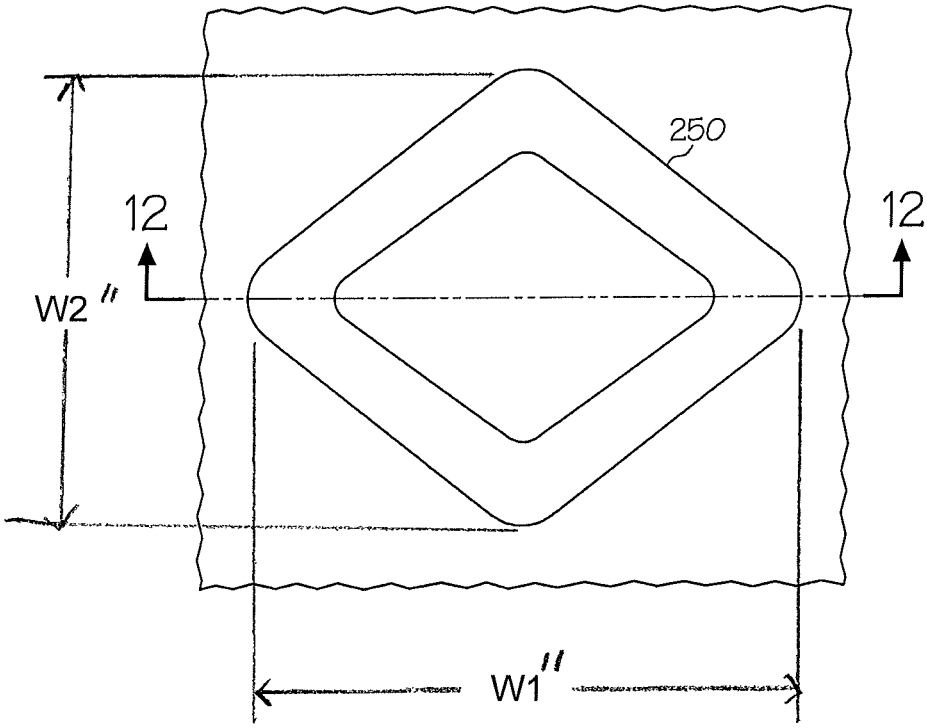
FIG. 11 depicts a top view of an exemplary embossment for the track member of FIG. 8.
Figure 12:
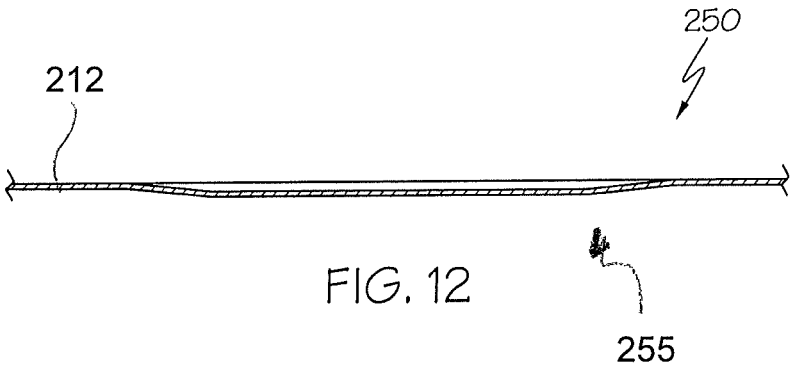
FIG. 12 depicts a detailed cross-sectional view of the embossment of FIG. 11 taken along line 12-12 of FIG. 11.

FIGS. 8-12 depict an exemplary embodiment of a track member 210. In the illustrated embodiment, track member 210 comprises a u-shaped member that includes a base portion flanked on opposite sides by a pair of flanges 214, 216. As shown, the base portion defines a web 212. In various embodiments, the juncture of web 12 with each flange 14, 16 may comprise a radius between about 0.020" (0.051 cm) and about 0.100" (0.254 cm), and, preferably, in one embodiment the juncture may comprise a radius of about 0.040" (0.102 cm), although this is not required and other suitable radii may be used in other embodiments. The material thickness of track member 210 may range from about 0.0145" (0.037 cm) to about 0.0346" (0.088 cm), or any other suitable dimension depending on the particular application in which the track member is being used. In various embodiments, the material thickness of stud 210 may be about 0.0150" (0.038 cm), about 0.0179" (0.045 cm), about 0.022" (0.056 cm), about 0.026" (0.066 cm), about 0.0296" (0.075 cm), or about 0.0329" (0.084 cm). The depth of web 212 may correspond to the nominal inside depth D" of track member 210. As used herein "nominal inside depth" refers to the dimension measured from the inner surface of flange 214 to the inner surface of flange 216. By way of example only, in a track member having a nominal inside depth D" of about 1⅝" (4.128 cm), the depth of the web may be about 1⅝" (4.128 cm). The nominal inside depth D" of track member 210 may preferably range from about 1⅝" (4.128 cm) to about 6" (15.240 cm), although the inside depth D" is not required to be within this range. In various embodiments, the nominal inside depth D" of stud 210 may comprise about 1⅝" (4.128 cm), about 2½" (6.350 cm), about 3½" (8.890 cm), about 3⅝" (9.208 cm), about 4" (10.160 cm), about 5½" (13.970 cm), or about 6" (15.240 cm). The nominal leg length L of each flange 214, 216 of track member 210 may preferably range from about ¾" (1.905 cm) to about 3¼" (8.255 cm), although the leg length is not required to be within this range. In a preferred embodiment, each flange 214, 216 may comprise a nominal leg length L of about 1¼" (3.175 cm). One or both flanges 214, 216 may include a knurled portion, although this is not required. In some embodiments, the knurled portion may include 7 or 9 rows of knurling, although any suitable amount of knurling may be used. As shown, each flange 214, 216 extends along a respective side edge of the web 212 in a generally uniform plane generally perpendicular to web 212. Preferably, the angle between each flange 214, 216 and web 212 ranges from about 75 degrees to about 95 degrees, and even more preferably, the angle between each flange 214, 216 and web 212 is about 88 degrees, although this is not required. Each flange 214, 216 comprises a fixed end attached to web 212 and a free end at the opposite end of the flange 214, 216. As shown in FIG. 9, the free end of each flange 214, 216 may be hemmed (i.e. the end of the material is folded back on itself) in order to help reduce the sharpness of the track edge, although this is not required. The corners of track member 210 may be curved with maximum inside radii ranging from about 0.020" (0.051 cm) to about 0.100" (0.254 cm). In a preferred embodiment, the maximum inside radii for the corners of track member 210 may be about 0.040" (0.102 cm), however any other suitable maximum radii may be used depending on the particular application in which the track member is being used.

In alternate embodiments, the track member may include one or more punchouts or openings in the web, similar to the punchouts 415 described below, but this is not required. Of course, the shape, size, and location of the punchouts may vary depending on the particular application of the track member.

As shown in FIGS. 8-12, each flange 214, 216 comprises two longitudinally extending stiffeners 222, 224 that have an arcuate cross-section. In some embodiments, longitudinally extending stiffeners 222, 224 may be generally similar to longitudinally extending stiffeners 22, 24, 26, but this is not required. In one embodiment, longitudinally extending stiffeners 222, 224 may comprise a radius between about 0.020" (0.051 cm) and about 0.050" (0.127 cm), and preferably a radius of about 0.030" (0.076 cm). Additionally, longitudinally extending stiffeners 222, 224 may comprise a height (i.e. the distance from the lowest point of the longitudinally extending stiffener 222, 224 to the outer surface of the respective flange 214, 216) within a range from about 0.010" (0.025 cm) to about 0.030" (0.076 cm), and preferably a height of about 0.015" (0.038 cm). In addition, longitudinally extending stiffeners 222, 224 may be configured to form an angle a" within a range of about 45 degrees to about 150 degrees, and preferably an angle a" of about 135 degrees. Of course, other suitable configurations, radii and angles for the longitudinally extending stiffeners may be used in alternate embodiments. The shape and dimensions of longitudinally extending stiffeners 222, 224 may be selected so that longitudinally extending stiffeners 222, 224 help prevent a fastener, such as a screw, from sliding during installation. If longitudinally extending stiffeners 222, 224 are too high or wide, they may inhibit installation by allowing a fastener to drag during insertion through flange 214, 216. In addition, if longitudinally extending stiffeners 222, 224 have a height that is too large, then that may result in difficulties during fabrication. To the contrary, the shape and dimensions of longitudinally extending stiffeners 222, 224 may be selected so that longitudinally extending stiffeners 222, 224 provide adequate stiffness in flanges 214, 216 while avoiding significant problems during fabrication, such as tearing or damaging the material. By way of example only, the shape and ranges of dimensions described above may allow longitudinally extending stiffeners 222, 224 to meet these criteria. The criteria for determining appropriate shapes and dimensions for longitudinally extending stiffeners 222, 224 will be known to those of ordinary skill in the art.

It will be appreciated that alternate embodiments may comprise alternate numbers of longitudinally extending stiffeners and/or longitudinally extending stiffeners with other cross-sections depending on the particular application in which track member is being used. By way of example only, alternate cross-sections of the longitudinally extending stiffeners may include but are not limited to semi-circular, square, and other curved shapes. The longitudinally extending stiffeners 222, 224 may extend generally along the entire length of the flange or, alternatively, along a portion that is less than the entire length of the flange 214, 216. In addition, the depth and radii of the longitudinally extending stiffeners may vary based on the particular application in which the track member is being used. Various characteristics of longitudinally extending stiffeners 222, 224, including but not limited to shape, orientation and configuration, may be varied, as discussed above with regard to longitudinally extending stiffeners 22, 24, 26.

In this embodiment, the closed portion of each longitudinally extending stiffener 222, 224 extends inwardly from the flange 214, 216 towards the interior cavity 255 formed by track member 210 and the opening of each longitudinally extending stiffener 222, 224 is outwardly oriented. In an alternate embodiment, each longitudinally extending stiffener may be configured such that the closed portion of each longitudinally extending stiffener extends outwardly from the flange, and the opening of each longitudinally extending stiffener is inwardly oriented toward the interior cavity of the stud. In yet another alternate embodiment including two or more longitudinally extending stiffeners, at least one longitudinally extending stiffener may be configured such that its closed portion extends outwardly from the flange and its opening is inwardly oriented toward the interior cavity of the stud, while at least one other longitudinally extending stiffener is configured such that its closed portion extends inwardly from the flange toward the interior cavity of the stud and its opening is outwardly oriented. In some embodiments, the longitudinally extending stiffener 222 closest to web 212 may be spaced apart from web 212 a distance within the range of about 0.125" (0.318 cm) to about ½" (1.270 cm). In addition, in some embodiments, the longitudinally extending stiffeners 222, 224 may be spaced apart from each other a distance within the range of about ¼" (0.635 cm) to about ¾" (1.905 cm). In the illustrated embodiment, the longitudinally extending stiffener 222 closest to web 212 is spaced apart from web 212 a distance of about ¼" (0.635 cm) and longitudinally extending stiffeners 222, 224 are spaced approximately ⅜" (0.953 cm) apart from each other, but other spacing may be utilized depending on the particular application.

Longitudinally extending stiffeners 222, 224 in flanges 214, 216 of track member 210 may increase the overall stiffness of track member 210 by placing more material away from the center of gravity, thereby increasing the second moment of inertia of the final product. In other words, as material is shifted away from the central or neutral axis of the track member 210, the stiffness of the track member 210 may be increased. In addition, longitudinally extending stiffeners 222, 224 may also help reduce local buckling by increasing the section modulus in the same manner that they increase the second moment of inertia. Specifically, longitudinally extending stiffeners 222, 224 may help reduce or restrain local buckling and increase the strength of track member 210 by decreasing the width of the flat area on each flange 214, 216 so that local wave action is restrained. In addition, if longitudinally extending stiffeners 22, 24, 26 are cold formed, then that process may work-harden the steel, which may increase the yield strength of the material and give track member 210 increased strength. Specifically, longitudinally extending stiffeners 222, 224 comprising dimensions within the ranges described above or meeting the other criteria discussed above may provide adequate stiffening while avoiding problems during fabrication. The criteria for determining appropriate shapes and dimensions for longitudinally extending stiffeners 222, 224 will be known to those of ordinary skill in the art.

Longitudinally extending stiffeners 222, 224 may be added to track member 210 after the embossments 250 (described below) have been formed in web 212, although this is not required. Track member 210 may also undergo roll-forming after embossment.

The embodiment shown in FIGS. 8-12 includes a plurality of embossments 250 positioned along the centerline of web 212. In the illustrated embodiment, embossments 250 are positioned along the centerline of web 212 such that each embossment 250 is symmetrical about the centerline. Of course, in other embodiments, one or more embossments may be positioned along the centerline without being symmetrical about the centerline, which may result from the particular shape and/or position of the non-symmetrical embossments. Embossments 250 may be generally identical to embossments 50 described above. In various embodiments, embossments 250 may comprise a raised portion that extends a distance above web 212 (i.e. the "height of the embossment"), wherein the height of the embossment 250 is within the range of about 0.020" (0.051 cm) to about 0.050" (0.127 cm). In a preferred embodiment, embossments 250 may comprise a height of about 0.025" (0.064 cm). Of course, other suitable dimensions may be used depending on the particular application involved. In addition, embossments 250 may extend from the flat surface of web 212 at an angle within the range of about 5 degrees to about 15 degrees, although other suitable angles may be used in other embodiments. In a preferred embodiment, embossments 250 may extend from the flat surface of web 212 at an angle of about 6 degrees. Alternate embodiments of track members may comprise embossments positioned somewhere along the web other than along the centerline, while still further embodiments may comprise a generally flat web without embossments. The embossments 250 may be generally evenly spaced along generally the entire length of the web 212, or, alternatively, along a portion that is less than the entire length of the web 212. In some embodiments, embossments 250 may be un-evenly spaced along at least a portion of web 212. In various embodiments, embossments 250 may be spaced apart a distance within the range of about 1¾" (4.445 cm) to about 4" (10.160 cm). In a preferred embodiment, embossments 250 may be spaced about 2" (5.080 cm) apart (center to center), although the spacing may be varied based on the particular application in which the stud is being used.

Embossments 250 may be inwardly oriented such that they extend inwardly from the plane of web 212 into the interior cavity 255 of track member 210. In an alternate embodiment, the embossments may be outwardly oriented, such that they extend outwardly from the plane of the web away from the interior cavity of the track. In yet another alternate embodiment including two or more embossments, at least one embossment may be inwardly oriented, while at least one other embossment may be outwardly oriented. In the illustrated embodiment, embossments 250 comprise a diamond shape, although other suitable shapes may be used depending on the particular application in which the track member is being used. By way of example only, alternate embodiments may include, but is not limited to, embossments comprising one or more of the following shapes: diamond shaped, circular, bar-shaped, oval, chevron-shaped, rectangular, hexagonal, z-shaped, and letter-shaped. As shown, embossments 250 are generally identical shapes and sizes. Alternate embodiments may comprise a plurality of embossments wherein at least some of the embossments are different shapes and/or sizes. The embossments may comprise any suitable length, width, depth, and spacing depending on the particular application in which the stud is being used. In various embodiments, each embossment may comprise a longitudinal width w1" within the range of about 1" (2.540 cm) to about 3" (7.620 cm) and a transverse width w2" within the range of about 1" (2.540 cm) to about 2" (5.080 cm). By way of example only, in a preferred embodiment, each embossment 250 may comprise a longitudinal width w1" of about 1⁹⁄₁₆" (3.969 cm) and a transverse width w2" of about 1¼" (3.175 cm). In addition, the dimensions of the embossments within a single structural framing member may vary by about 25% without affecting the performance of the structural framing member.

Embossments 250 may help locally stiffen track member 210 and help prevent deflection, thereby improving track member's 210 performance during handling and installation. The design of features formed in track member 210, including longitudinally extending stiffeners 222, 224 and embossments 250, including both the overall shapes and the dimensions of each of these features may be impacted by the type of material used to form track member 210. By way of example only, particular shapes and dimensions for the features may be selected in order to allow track member 210 to be made out of high strength steels (i.e. steels with yield strengths exceeding about 50 ksi (344.738 MPa)). Of course, this is not required and track member 210 may be made out of any suitable material, including but not limited to steel, stainless steel, aluminum, plastics, other polymer-based or reinforced materials, and combinations thereof. By way of example only, the shapes and ranges of dimensions described above for each of the features may allow track member 210 to be made from high strength steels. The height of the features may be limited depending on the material used, because features with large heights may result in cracking of the steel, particularly in high strength steels. The criteria for determining appropriate combinations of shapes and dimensions for features and material for the track member will be known to those or ordinary skill in the art. As with the design of embossments 50 described above, the design of embossments 250 may help facilitate use of high strength steels. Accordingly, the description of how the design of embossments 50 aids in the use of high strength steels will not be repeated here.

In the illustrated embodiment, web 212 does not include any longitudinally extending offsets. In alternate embodiments, the web of a track member may comprise one or more longitudinally extending offsets. Specifically, in one embodiment, the web of a track member may comprise a single longitudinally extending offset, similar to longitudinally extending offset 130 in stud 110 described above. In another alternate embodiment, the web of a track member may comprise two longitudinally extending offsets, similar to longitudinally extending offsets 30, 40 in stud 10 described above. Of course, in still other alternate embodiments, the web of a track member may comprise any suitable number of longitudinally extending offsets in any suitable arrangement or configuration depending on the particular application of the track member.

In one exemplary embodiment, a track member generally similar to track member 210 described above is manufactured with the following dimensions within generally accepted manufacturing tolerances, including those in accordance with ASTM C645 and IBC 2006, which are well-known to those of ordinary skill in the art:

- Radius of juncture between the web and each flange=about 0.040" (0.102 cm);
- Material thickness=about 0.022" (0.056 cm);
- Nominal inside depth (D") of the track member=about 3⅝" (9.208 cm);
- Nominal leg length (L) of each flange=about 1¼" (3.175 cm);
- Maximum inside radii for corners of the track member=about 0.040" (0.102 cm);
- Radius of each of the longitudinally extending stiffeners=about 0.030" (0.076 cm);
- Height of each of the longitudinally extending stiffeners=about 0.015" (0.038 cm);
- Distance between the web and the closest longitudinally extending stiffener=about ¼" (0.635 cm);
- Spacing between the longitudinally extending stiffeners=about ⅜" (0.953 cm);
- Height of the embossments=about 0.025" (0.064 cm);
- Spacing between the embossments=about 2" (5.080 cm);
- Longitudinal width (w1) of each embossment=about 1 9/16" (3.969 cm);
- Transverse width (w2) of each embossment=about 1¼" (3.175 cm);
- Angle between the web and each flange=about 88 degrees;
- Angle (a) formed by the longitudinally extending stiffeners=about 135 degrees; and
- Angle that the embossment extends from the face of the web=about 6 degrees.

Of course, other embodiments may have other suitable dimensions and combinations thereof.

Figure 13:
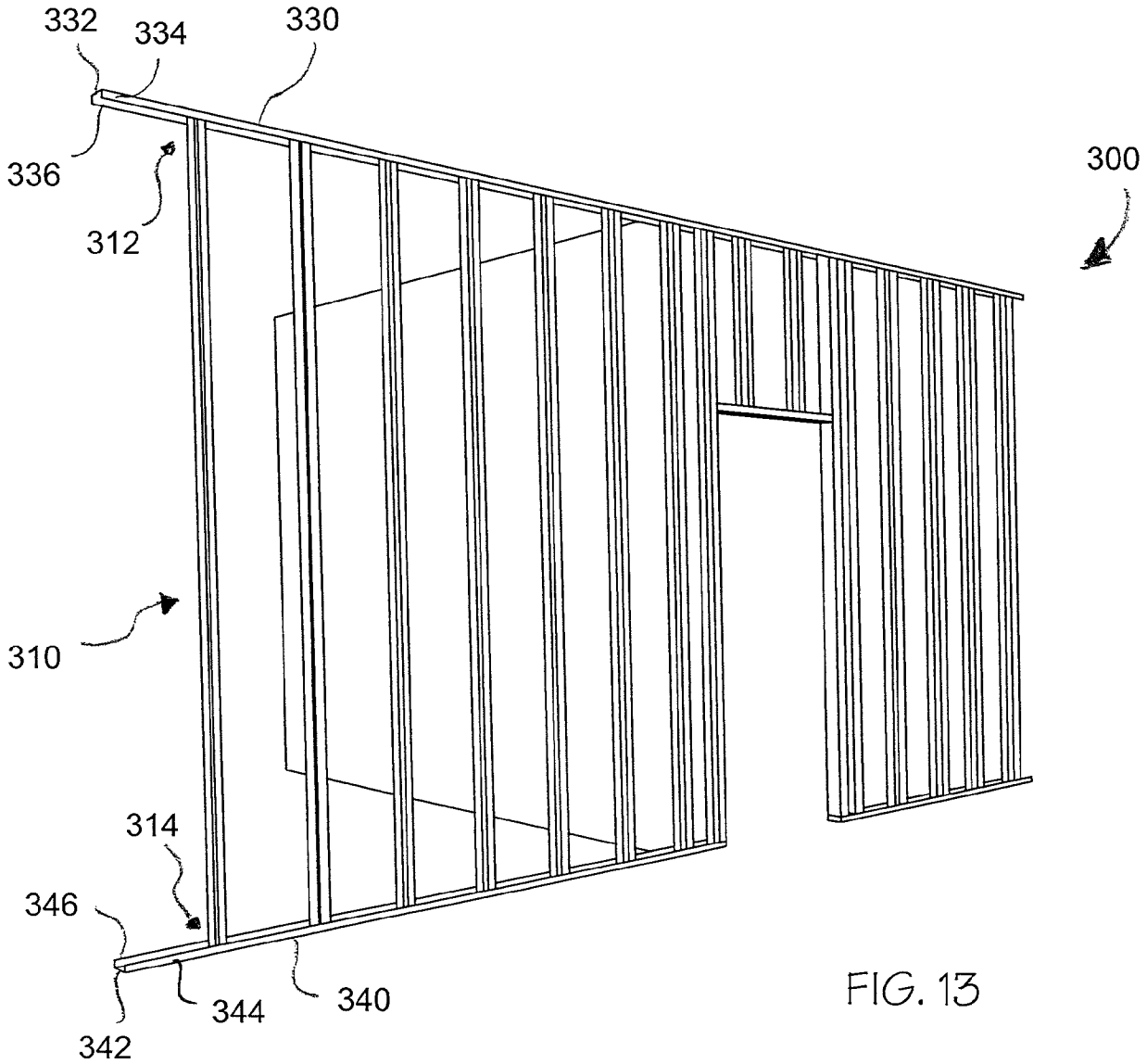
FIG. 13 depicts a perspective view of an exemplary framing assembly incorporating exemplary studs and exemplary track members.

FIG. 13 depicts an exemplary framing system 300 comprising a plurality of studs 310 positioned between an upper track member 330 and a lower track member 340. In some embodiments, studs 310 may comprise a stud similar to studs 10 or 110 described above. Similarly, in some embodiments, upper track member 330 and lower track member 340 may comprise track members similar to track member 210 described above. In the illustrated embodiment, upper track member 330 comprises a web 332 and a pair of flanges 334 and 336, while lower track member 340 comprises a web 342 and a pair of flanges 344, 346. As shown, stud 310 comprises an upper end 312 and a lower end 314.

In this embodiment, framing assembly 300 is formed by positioning upper track member 330 and lower track member 340 opposite each other such that the interior cavity of upper track member 330 is facing the interior cavity of lower track member 340. In the illustrated embodiment, each stud 310 is positioned such that upper end 312 is received into the interior cavity of upper track member 330 between flanges 334 and 336. Each stud 310 may be configured such that each flange of each stud 310 is adjacent to, and in some embodiments abutting, a corresponding flange 334, 336 of upper track member 330. Similarly, as shown, lower end 314 of each stud is received into the interior cavity of lower track member 340 between flanges 344 and 346. Each stud 310 may be configured such that each flange of each stud 310 is adjacent to, and in some embodiments abutting, a corresponding flange 344, 346 of lower track member 340. In some embodiments, upper end 312 of each stud 310 abuts web 332 of upper track member 330 and lower end 314 of each stud 310 abuts web 342 of lower track member 340, but this is not necessarily required. As shown, when stud 310 is inserted into upper track member 330 and lower track member 340, the web of stud 310 is generally perpendicular to web 332 of upper track member 330 and web 342 of lower track member 340. In addition, in embodiments where stud 310, upper track member 330, and lower track member 340 each comprise one or more longitudinally extending stiffeners in each flange, the longitudinally extending stiffener(s) in the flanges of stud 310 may be generally perpendicular to the longitudinally extending stiffener(s) in flanges 334, 336 of upper track member 330 and the longitudinally extending stiffener(s) in flanges 344, 346 of lower track member 340. Each stud 310 may be secured to upper track member 330 using one or more fasteners inserted through one of the flanges 334, 336 in upper track member 330 and a portion of the adjacent flange in stud 310. Similarly, each stud 310 may be secured to lower track member 340 using one or more fasteners inserted through one of the flanges 344, 346 in lower track member 340 and a portion of the adjacent flange in stud 310. Of course, any suitable type of fastener or other fastening method or device may be used to provide adequate engagement between each stud 310 and upper and lower track members 330, 340. In some embodiments, separate fasteners may not be required to connect studs 310 to upper track member 330 and lower track member 340. In those embodiments, the components of framing assembly 300 (i.e. studs, 310, upper track member 330, and lower track member 340) may be configured to provide a friction fit between components and/or be connected together via the panels, such as gypsum panels, that are installed onto framing assembly 300.

Framing assembly 300 may be used for any suitable part of a structure, including both internal and external walls. The plurality of studs 310 may be spaced apart any suitable distance. In some embodiments, studs 310 may be evenly spaced apart along the length of upper track member 330 and lower track member 340 at intervals of about 8" (20.320 cm), about 12" (30.480 cm), about 16" (40.640 cm), about 19.2" (48.786 cm), about 24" (60.960 cm), or about 48" (121.920 cm) on center. Of course, other suitable spacing of studs 310 for framing assembly 300 may be apparent to those of ordinary skill in the art. In some embodiments, such as framing assembly 400 shown in FIG. 14 and described below, other components, including but not limited to gypsum panels, may be attached to studs 310 and/or upper track member 330 and lower track member 340. In some embodiments, longitudinally extending stiffeners in the flanges of studs 310 may be used to facilitate alignment and/or attachment of the panels, as described above. One or both of upper track member 330 and lower track member 340 may be attached to a support surface, including but not limited to a floor, a ceiling, a joist, or another structural framing member, in order to stabilize framing assembly 300.

FIG. 14 depicts a detailed view of an alternate framing assembly 400 comprising a plurality of studs 410 and an upper track member 430. Of course, framing assembly 400 may comprise additional components, including a lower track member, but those are not shown in this particular figure. In some embodiments, studs 410 may comprise a stud similar to studs 10 or 110 described above. Similarly, in some embodiments, upper track member 430 may comprise a track member similar to track member 210 described above. In the illustrated embodiment, upper track member 430 comprises a web 432 and a pair of flanges 434 and 436. As shown, stud 410 comprises a web 412 and a pair of flanges 414, 416 and an upper end 418. In the illustrated embodiment, each stud 410 comprises a plurality of embossments along web 412 and a plurality of longitudinally extending stiffeners formed in each of the flanges 414, 416. As shown, web 412 of each stud 410 further comprises a punchout 415 (i.e. an opening) configured to allow structural framing member 470 to pass through the plurality of studs 410. Of course, punchouts 415 may be configured to allow any suitable member or material to be passed through studs 410, including but not limited to wiring, pipes, conduits, and structural framing members. Punchouts 415 may comprise any shape or size opening suitable to provide passage of the desired member or materials. Punchouts 415 in each stud may be aligned with the punchout 415 in adjacent studs 410, although this is not required. In embodiments including more than one punchout in each stud, the punchouts may be spaced apart any suitable distance. In the illustrated embodiment, upper track member 430 comprises two longitudinally extending stiffeners extending along each of the flanges 434, 436. While the illustrated embodiment of upper track member 430 does not include any embossments in web 432, it will be appreciated that in other embodiments, upper track member 430 may include embossments in web 432.

As shown in FIG. 14, upper track member 430 is attached to support surface 480. Support surface 480 may comprise a ceiling, joist, or other structural member. Similar to framing assembly 300 shown in FIG. 13 and described above, each stud 410 in framing assembly 400 is positioned such that upper end 418 is received into the interior cavity of upper track member 430 between flanges 434 and 436. Each stud 410 may be configured such that a portion of each flange 414, 416 of each stud 410 is adjacent to, and in some embodiments abutting, a corresponding flange 434, 436 of upper track member 430. In some embodiments, upper end 418 of each stud 410 abuts web 432 of upper track member 430, but this is not necessarily required. As shown, when stud 410 is inserted into upper track member 430, web 412 of stud 410 is generally perpendicular to web 432 of upper track member 430. In addition, as shown, when stud 410 is inserted into upper track member 430, the longitudinally extending stiffeners in flanges 414, 416 of stud 410 are generally perpendicular to the longitudinally extending stiffeners in flanges 434, 436 of upper track member 430. Each stud 410 may be secured to upper track member 430 using one or more fasteners inserted through one of the flanges 434, 436 in upper track member 430 and a portion of the adjacent flange 414, 416 in stud 410. Of course, any suitable type of fastener or other fastening method or device may be used to provide adequate engagement between each stud 410 and upper track member 430. In some embodiments, separate fasteners may not be required to connect studs 410 to upper track member 430. In those embodiments, the components of framing studs 410 and upper track member may be may be configured to provide a friction fit between components and/or be connected together via the panels 460 that are installed onto framing assembly 400.

Framing assembly 400 may be used for any suitable part of a structure, including both internal and external walls. The plurality of studs 410 may be spaced apart any suitable distance. In some embodiments, studs 410 may be evenly spaced apart along the length of upper track member 430 at intervals of about 8" (20.320 cm), about 12" (30.480 cm), about 16" (40.640 cm), about 19.2" (48.786 cm), about 24" (60.960 cm), or about 48" (121.920 cm) on center. Of course, other suitable spacing of studs 410 for framing assembly 400 may be apparent to those of ordinary skill in the art. In the illustrated embodiment, a pair of panels 460 are attached to either side of framing assembly 400. Specifically, a first panel 460 is positioned such that the inner surface of the first panel 460 rests against flanges 414 of studs 410. Similarly, a second panel 460 is positioned such that the inner surface of the second panel 460 rests against flanges 416 of studs 410. In some embodiments, longitudinally extending stiffeners in the flanges 414, 416 of studs 410 may be used to facilitate alignment and/or attachment of the panels 460, as described above. Panels 460 may be attached to studs 410 by passing one or more fasteners through a panel 460 and through a portion of the adjacent flange 414, 416. Of course, any suitable type of fastener or other fastening method or device may be used to provide adequate engagement between each stud 410 and panels 460.

Structural framing members, such as those described above, may be fabricated using a variety of fabrication processes. By way of example only, such structural framing members may be fabricated using a progressive roll-forming process that is known to those of ordinary skill in the art. One exemplary fabrication process may comprise some combination of the following steps. First, a flat continuous strip of steel may be passed between and through a pair of embossing rolls, one male and one female, to form the embossments on the strip. Obviously, this embossment step is not necessary if the structural framing member does not require embossments. The continuous strip may then be passed through a cold forming machine (roll former) where the continuous strip is formed into the final shape by a series of cold forming roller dies. The number of forming roller dies may vary depending on the design of the machine. In addition to being formed into the final shape, the cold forming machine may also form various features into the strip, including but not limited to one or more longitudinally extending stiffeners in the flanges, one or more longitudinally extending offsets in the web, and return lips along the free ends of each flange. The design of a particular structural framing member may require multiple passes through one or more sets of rollers. The strip may be cut to various lengths either before the continuous strip enters the cold forming machine or after the formed strip exits the cold forming machine depending on machine design. The specific features formed into the strip and the overall shape of the structural framing member may vary based on the type of structural framing member being formed and the particular application in which the structural framing member will be used. The structural framing members, which have been cut to length, may be stacked or bundled for storage and/or shipment.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention is understood not to be limited to the details of structure and operation shown and described in the specification and drawings.

What is claimed is:

1. A metal stud comprising:

a. a web, wherein the web comprises i. a longitudinal centerline, ii. a first side edge, iii. a second side edge, iv. a plurality of embossments, wherein the plurality of embossments consists of embossments positioned generally along the longitudinal centerline of the web such that the longitudinal centerline of the web intersects each embossment, wherein each embossment comprises a longitudinal width and a transverse width, wherein the longitudinal width is greater than the transverse width, wherein at least one of the plurality of embossments is not contiguous to any openings in the web, and v. at least one longitudinally extending offset, wherein the at least one longitudinally extending offset is positioned closer to one of the first side edge and the second side edge than to the plurality of embossments;

b. a first flange, wherein the first flange is attached to the first side edge of the web at a first fixed end, wherein the first flange is oriented generally perpendicular to a plane of the web, wherein the first flange comprises i. at least one longitudinally extending stiffener, and ii. a first free end distal from the first fixed end, wherein the first free end is bent to form a first return lip; and c. a second flange, wherein the second flange is attached to the second side edge of the web at a second fixed end, wherein the second flange is oriented generally perpendicular to the plane of the web, wherein the second flange comprises i. at least one longitudinally extending stiffener, and ii. a second free end distal from the second fixed end, wherein the second free end is bent to form a second return lip.

2. The metal stud of claim 1, wherein the at least one longitudinally extending offset is a first longitudinally extending offset, wherein the first longitudinally extending offset is positioned between the longitudinal centerline and the first side edge; and, wherein the web further comprises a second longitudinally extending offset, wherein the second longitudinally extending offset is positioned between the longitudinal centerline and the second side edge.

3. The metal stud of claim 1, wherein the at least one longitudinally extending stiffener in the first flange comprises at least three evenly spaced longitudinally extending stiffeners; and wherein the at least one longitudinally extending stiffener in the second flange comprises at least three evenly spaced longitudinally extending stiffeners.

4. The metal stud of claim 3, wherein one of the at least three evenly spaced longitudinally extending stiffeners in the first flange extends along a longitudinal centerline of the first flange.

5. The metal stud of claim 4, wherein one of the at least three evenly spaced longitudinally extending stiffeners in the second flange extends along a longitudinal centerline of the second flange.

6. The metal stud of claim 3, wherein the at least three evenly spaced longitudinally extending stiffeners are spaced apart about ⅜" (0.953 cm) apart from each other.

7. The metal stud of claim 1, wherein at least one of the first flange and the second flange further comprises a knurled portion.

8. The metal stud of claim 1, wherein the at least one of the plurality of embossments comprises a diamond shape.

9. The metal stud of claim 1, wherein the plurality of embossments each comprise generally the same shape.

10. The metal stud of claim 1, wherein the web further comprises at least one punchout.

11. The metal stud of claim 1 further comprising an inner cavity, wherein the inner cavity is defined by the web, the first flange and the second flange.

12. The metal stud of claim 11, wherein the at least one of the plurality of embossments extends inwardly into the inner cavity.

13. The metal stud of claim 11, wherein the at least one longitudinally extending offset extends inwardly into the inner cavity.

14. The metal stud of claim 11, wherein the at least one longitudinally extending stiffener in the first flange extends inwardly into the inner cavity, wherein the at least one longitudinally extending stiffener in the second flange extends inwardly into the inner cavity.

15. A metal stud comprising:

a. a web, wherein the web comprises i. a longitudinal centerline, ii. a first side edge, iii. a second side edge, iv. a plurality of embossments, wherein the plurality of embossments are positioned on a central portion of the web along the longitudinal centerline of the web, and v. a first offset, wherein the first offset is positioned between the longitudinal centerline and the first side edge, vi. a second offset, wherein the second offset is positioned between the longitudinal centerline and the second side edge, vii. a first outer portion that extends from an exterior longitudinal edge of the first offset to the first side edge, wherein the distance from the exterior longitudinal edge of the first offset to the first side edge is less than the distance from the exterior longitudinal edge of the first offset to the plurality of embossments, and viii. a second outer portion that extends from an exterior longitudinal edge of the second offset to the second side edge, wherein the central portion of the web comprises a central web surface extending from an edge of at least one of the plurality of embossments to an interior longitudinal edge of the first offset, wherein the central web surface is substantially planar;

wherein the central portion of the web, the first outer portion, and the second outer portion are all substantially coplanar with each other;

b. a first flange including a fixed edge and a free end, wherein the fixed edge of the first flange is attached to the first side edge of the web and extends generally along the first side edge in a direction generally perpendicular to a plane of the web, wherein the first flange comprises at least three evenly spaced longitudinally extending stiffeners, and wherein the first free end is bent to form a first return lip, and c. a second flange, including a fixed edge and a free end, wherein the fixed edge of the second flange is attached to the second side edge of the web and extends generally along the second side edge in a direction generally perpendicular to a plane of the web, wherein the second flange comprises at least three evenly spaced longitudinally extending stiffeners, and wherein the second free end is bent to form a second return lip.

16. The metal stud of claim 15 further comprising an inner cavity, wherein the inner cavity is formed by the web, the first flange and the second flange.

17. The metal stud of claim 16, wherein at least one of the plurality of embossments extends inwardly into the inner cavity.

18. The metal stud of claim 16, wherein at least one of the at least three longitudinally extending stiffeners in the first flange extend inwardly into the inner cavity and open outwardly away from the inner cavity.

19. The metal stud of claim 16, wherein the first offset extends inwardly into the inner cavity, wherein the second offset extends inwardly into inner cavity.

20. The metal stud of claim 15 wherein the first flange extends from the web at a first flange angle, wherein the first flange angle is between about 85 degrees and about 95 degrees, wherein the second flange extends from the web at a second flange angle, wherein the second flange angle is between about 85 degrees and about 95 degrees.

21. The metal The stud of claim 15, wherein the first return lip extends from the first flange at a first lip angle, wherein the first lip angle is between about 45 degrees and about 100 degrees, wherein the second return lip extends from the second flange at a second lip angle, wherein the second lip angle is between about 45 degrees and about 100 degrees.

22. A metal track member comprising a. a web, wherein the web comprises i. a first side edge, ii. a second side edge, iii. a longitudinal centerline, and iv. a plurality of embossments, wherein the plurality of embossments consists of embossments positioned generally along the longitudinal centerline of the web such that the longitudinal centerline of the web intersects each embossment, wherein each embossment comprises a longitudinal width and a transverse width, wherein the longitudinal width is greater than the transverse width, wherein at least one of the plurality of embossments is not contiguous to any openings in the web;

b. a first flange including a first, fixed, side edge and a second, free, side edge, wherein the first side edge of the first flange is attached to the web at the first side edge thereof, wherein the second side edge is hemmed, wherein the first flange comprises at least two longitudinally extending stiffeners, and c. a second flange including a first, fixed side edge and a second, free, side edge, wherein the first side edge of the second flange is attached to the web at the second side edge thereof, wherein the second flange comprises at least two longitudinally extending stiffeners, and wherein the first and second flanges are oriented generally perpendicular to a plane of the web.

23. The metal track member of claim 22 further comprising an inner cavity, wherein the inner cavity is defined by the web, the first flange and the second flange.

24. The metal track member of claim 23, wherein the at least one of the plurality of embossments extends inwardly into the inner cavity.

25. The metal track member of claim 23, wherein at least one of the at least two longitudinally extending stiffeners in the first flange extend inwardly into the inner cavity, wherein at least one of the at least two longitudinally extending stiffeners in the second flange extend inwardly into the inner cavity.

26. A framing assembly comprising:

a. a u-shaped first track member, wherein the first track member comprises i. a base portion defining a web, wherein the web comprises 1. a first side edge, and 2. a second side edge, ii. a first flange attached to the web at the first side edge, wherein the first flange comprises at least two longitudinally extending stiffeners, iii. a second flange attached to the web at the second side edge, wherein the second flange comprises at least two longitudinally extending stiffeners, and iv. a cavity defined by the web, the first flange, and the second flange; and b. a c-shaped stud, wherein the stud comprises
   i. a base portion defining a web, wherein the web comprises
      1. a longitudinal centerline,
      2. a first side edge,
      3. a second side edge,
      4. a plurality of embossments, wherein the plurality of embossments are positioned generally along the longitudinal centerline of the web, wherein at least one of the plurality of embossments is not contiguous to any openings in the web,
      5. a first longitudinally extending offset, wherein the first longitudinally extending offset is positioned between the longitudinal centerline and the first side edge, wherein the first longitudinally extending offset is positioned closer to the first side edge than to the plurality of embossments, and
      6. a second longitudinally extending offset, wherein the second longitudinally extending offset is positioned between the longitudinal centerline and the second side edge, wherein the second longitudinally extending offset is positioned closer to the second side edge than to the plurality of embossments;
   ii. a first flange, wherein the first flange is attached to the web at the first side edge, wherein the first flange comprises
      1. at least three evenly spaced longitudinally extending stiffeners comprising a first middle longitudinally extending stiffener and two first outer longitudinally extending stiffeners, wherein the first middle longitudinally extending stiffener is aligned with a longitudinal centerline of the first flange and the two first outer longitudinally extending stiffeners are equally spaced on either side of the first middle longitudinally extending stiffener, and
      2. a first return lip, and
   iii. a second flange, wherein the second flange is attached to the web at the second side edge, wherein the second flange comprises
      1. at least three evenly spaced longitudinally extending stiffeners comprising a second middle longitudinally extending stiffener and two second outer longitudinally extending stiffeners, wherein the second middle longitudinally extending stiffener is aligned with a longitudinal centerline of the second flange and the two second outer longitudinally extending stiffeners are equally spaced on either side of the second middle longitudinally extending stiffener, and
      2. a second return lip, and
   iv. a first end, wherein the first end is inserted into the cavity of the first track member such that
      1. the web of the stud is oriented generally perpendicular to the web of the first track member,
      2. a portion of the first flange of the stud is positioned adjacent to the first flange of the first track member, and
      3. a portion of the second flange of the stud is positioned adjacent to the second flange of the first track member.

27. The framing assembly of claim 26, wherein the web of the first track member further comprises a longitudinal centerline and a plurality of embossments, wherein the plurality of embossments is positioned generally along the longitudinal centerline of the web of the first track member.

28. The framing assembly of claim 26 further comprising a u-shaped second track member, wherein the second track member comprises
   a. a base portion defining a web, wherein the web comprises
      i. a first side edge, and
      ii. a second side edge,
   b. a first flange attached to the web at the first side edge, wherein the first flange comprises at least two longitudinally extending stiffeners,
   c. a second flange attached to the web at the second side edge, wherein the second flange comprises at least two longitudinally extending stiffeners, and
   d. a cavity defined by the web, the first flange, and the second flange;

wherein the stud further comprises a second end, wherein the second end is inserted into the cavity of the second track member such that
      i. the web of the stud is oriented generally perpendicular to the web of the second track member,
      ii. a portion of the first flange of the stud is positioned adjacent to the first flange of the second track member, and
      iii. a portion of the second flange of the stud is positioned adjacent to the second flange of the second track member.

29. The framing assembly of claim 28, wherein the web of the second track member further comprises a longitudinal centerline and a plurality of embossments, wherein the plurality of embossments is positioned generally along the longitudinal centerline of the web of the second track member.

30. The framing assembly of claim 26, wherein the first end of the stud is inserted into the cavity of the first track member such that the at least three longitudinally extending stiffeners in the first flange of the stud are oriented generally perpendicular to the at least two longitudinally extending stiffeners in the first flange of the first track member, and the at least three longitudinally extending stiffeners in the second flange of the stud are oriented generally perpendicular to the at least two longitudinally extending stiffeners in the second flange of the first track member.

31. The framing assembly of claim 26, wherein at least one of the at least two longitudinally extending stiffeners in the first flange of the first track member extend inwardly into the cavity, wherein at least one of the at least two longitudinally extending stiffeners in the second flange of the first track member extend inwardly into the cavity.

32. The framing assembly of claim 26, the stud further comprises an inner stud cavity defined by the web, the first flange, and the second flange of the stud.

33. The framing assembly of claim 32, wherein the at least one of the embossments in the web of the stud extends inwardly into the inner stud cavity.

34. The framing assembly of claim 32, wherein at least one of the at least three evenly spaced longitudinally extending stiffeners in the first flange of the stud extend inwardly into the inner stud cavity, wherein at least one of the at least three evenly spaced longitudinally extending stiffeners in the second flange of the stud extend inwardly into the inner stud cavity.

35. The framing assembly of claim 32, wherein the first longitudinally extending offset of the stud extends inwardly into the inner stud cavity, wherein the second longitudinally extending offset of the stud extends inwardly into the inner stud cavity.

* * * * *